US008146857B2

(12) United States Patent
Lovette

(10) Patent No.: US 8,146,857 B2
(45) Date of Patent: Apr. 3, 2012

(54) INITIATING FLIGHT OF A FLYING STRUCTURE

(75) Inventor: James Michael Lovette, Half Moon Bay, CA (US)

(73) Assignee: Freestyle Engineering, LLC, Santa Cruz, CA (US)

( * ) Notice: Subject to any disclaimer, the term of this patent is extended or adjusted under 35 U.S.C. 154(b) by 535 days.

(21) Appl. No.: 12/330,505

(22) Filed: Dec. 8, 2008

(65) Prior Publication Data

US 2009/0146002 A1 Jun. 11, 2009

Related U.S. Application Data

(60) Provisional application No. 61/012,029, filed on Dec. 6, 2007.

(51) Int. Cl.
*A63H 27/14* (2006.01)

(52) U.S. Cl. ..... 244/63; 446/30; 446/429

(58) Field of Classification Search ..... 244/63; 446/30–33, 63, 429
See application file for complete search history.

(56) References Cited

U.S. PATENT DOCUMENTS 2,649,263 A * 8/1953 Bayuk ..... 244/63
3,989,206 A 11/1976 Gregory
4,297,808 A * 11/1981 D'Andrade ..... 446/30
4,688,787 A * 8/1987 Vidal ..... 472/9
5,104,344 A * 4/1992 Jancso, Jr. ..... 446/31
6,572,482 B1 * 6/2003 Lewis, Jr. ..... 472/9

OTHER PUBLICATIONS

"DLG Version 2.0—RC Groups", [on-line]. © 2000-2008, Jetsoft Enterterprises Ltd. [retrieved Nov. 13, 2008]. Retrieved via the Internet: <URL: http://www.rcgroups.com/forums/showthread.php?t=152204>, (2008), 5 pgs.

Tidman, D. A, "Slingatron Overview", *Briefing to Air Force Future Concepts*, Team: Northrop Grumman, ALCorp, HyperV, (Jul. 12, 2005), 45 pgs.

* cited by examiner

*Primary Examiner* — Tien Dinh
*Assistant Examiner* — Michael Kreiner
(74) *Attorney, Agent, or Firm* — Schwegman, Lundberg & Woessner, P.A.

(57) ABSTRACT

In example embodiments described herein, techniques are described for launching flying structures such as a plank wings or a gliders, canards, or any other flying structures. In some example embodiments, a rotational arrangement facilitates such launches. In operation, a rotational arrangement couples with the flying structure and is configured to allow a user to impart rotational movement to the flying structure. In imparting the rotational movement, the rotational mechanism allows an automatic variation of a radius of the associated radius of curvature.

32 Claims, 19 Drawing Sheets

400 $F_c = mv^2/R$

500 $v = \sqrt{F_c \cdot R/m}$

PLANK WING

AFT-SWEPT WING

AFT-SWEPT WING

TOP VIEW

SIDE VIEW

WAGNER BLOCK & TACKLE SCHEMATIC

CENTRIPETAL LAUNCH LOADS PLOTTED SPAN-WISE

INITIATING FLIGHT OF A FLYING STRUCTURE

CLAIM OF PRIORITY

The present patent application claims the priority benefit of the filing date of U.S. provisional application No. 61/012,029 filed Dec. 6, 2007, the entire content of which is incorporated herein by reference.

TECHNICAL FIELD

This patent document pertains generally to flying structures, and more particularly, but not by way of limitation, to a flying structure and methods for initiating flight of a flying structure.

BACKGROUND

Flying structures may take various forms and may be used for various purposes. Likewise, there may be various ways to launch or propel existing flying structures.

BRIEF DESCRIPTION OF THE DRAWINGS

In the drawings, which are not necessarily drawn to scale, like numerals describe substantially similar components throughout the several views. Like numerals having different letter suffixes represent different instances of substantially similar components. The drawings illustrate generally, by way of example, but not by way of limitation, various embodiments discussed in the present document.

DETAILED DESCRIPTION

In example embodiments described herein, techniques are described for launching flying structures such as a plank wings or a gliders, canards, or any other flying structures. In some example embodiments, a rotational arrangement facilitates such launches. In operation, a rotational arrangement couples with the flying structure and is configured to allow a user to impart rotational movement to the flying structure. In imparting the rotational movement, the rotational arrangement allows an automatic variation of a radius of the associated radius of curvature.

Some example configurations include a user employable trigger coupled to the rotational arrangement and the automatic variation of the radius of rotation may be, for example, responsive to user employment of the trigger.

For some example embodiments, the rotational arrangement includes an effective member. The effective member may include a pliable material, a rigid material, an elastic material, or a combination of materials. The example effective member may be automatically adjusted by a centripetal force arising from the above described rotational motion. The automatic adjustment may position the effective member such that the effective member is extended between the user and the flying structure.

EXAMPLE EMBODIMENTS

Figure 1:
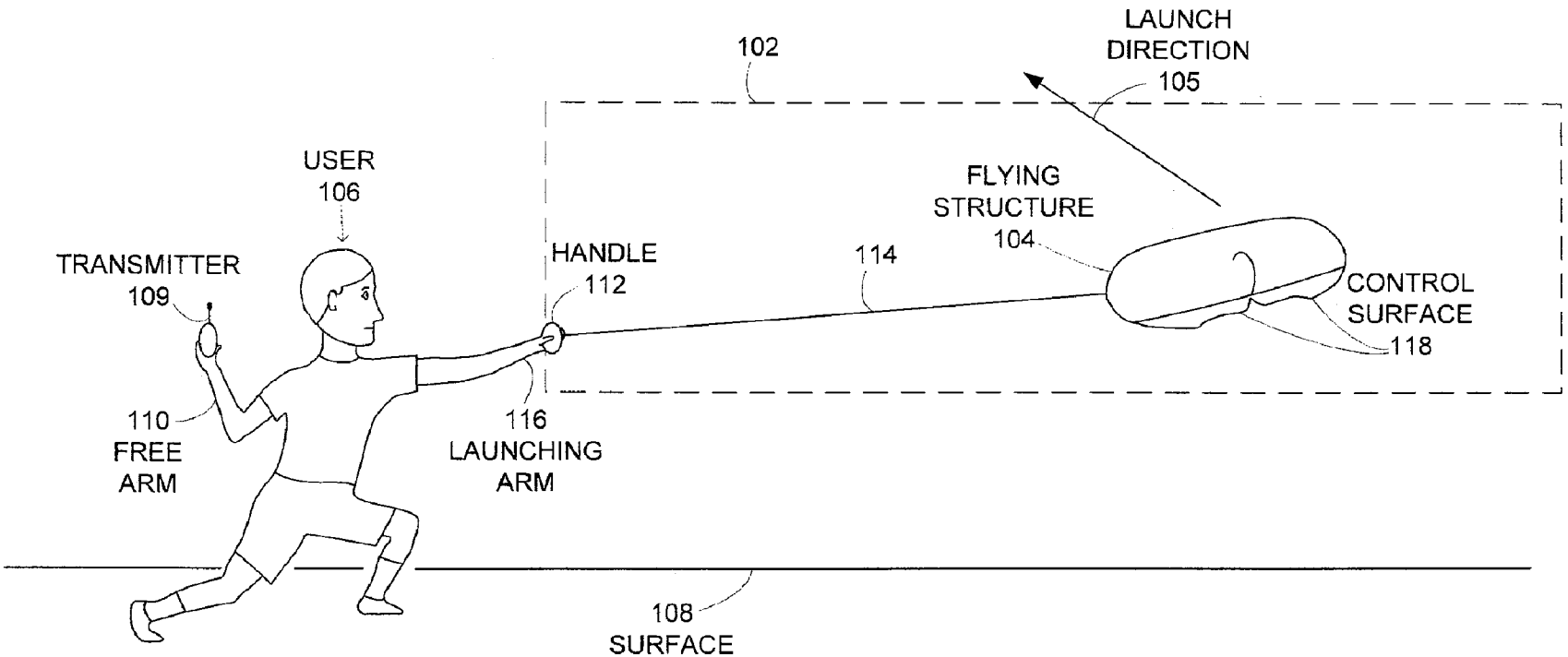
FIG. 1 is diagram illustrating an example apparatus being used to impart rotational movement to a flying structure, in accordance with an example embodiment.

FIG. 1 is diagram illustrating an example apparatus 102 being used to impart rotational movement to a flying structure 104, in accordance with an example embodiment. FIG. 1 is shown to include a user 106 standing on a surface 108 during the act of launching the flying structure 104 into flight in a launch direction. In some example embodiments, the user 106 is a human user. Alternatively or additionally the user, 106 may include a mechanical or non-human user that interacts with the apparatus 102. In an example embodiment, the user 106 holds a transmitter 109 (e.g., a remote controller) using a free arm 110 (e.g., the right hand) and physically contacts the apparatus at a handle 112 connected with the rotational arrangement 114 by using the launching arm 116 (e.g., the left hand).

The flying structure 104 is shown to be coupled to the rotational arrangement 114 (e.g., including a pliable and/or elastic material) that permits the user 106 to impart rotational movement to the flying structure 104. In example embodiments, the rotational movement induces a lift force based on the airflow permitted traverse the flying structure. The rotational arrangement may extend an effective member such as a length of tether (e.g., a pliable material) to provide a mechanical advantage for imparting the rotational movement. In an example embodiment, the lift force permits the flying structure 104 to be suspended in air.

The rotational arrangement 114 may further allow automatic variation of a radius of rotation defined by the rotational movement of the flying structure 104. The variation may include increasing, decreasing, or varying of any other aspect of radius of rotation. In various example embodiments, the rotational arrangement 114 includes a user employable trigger and the automatic variation of the radius of rotation is responsive to the user 106 employing (e.g., pulling) the trigger.

The flying structure 104 may be configured to be controlled with the transmitter 109. In some example embodiments, the transmitter 109 is packaged within the handle 112. The transmitter 109 may wirelessly transmit a movement command to a receiver located on the flying structure 104. The movement command may trigger movement of a control surface 118 of the flying structure 104 so as to change direction. Various examples of controlling the flying structure 104 may include controlling the speed, direction, and/or altitude of the flying structure 104, while a launch is being initiated and/or the flying structure 104 is in flight.

It may be appreciated that various flying structure designs and/or rotational arrangement designs are employable in different example embodiments. Flying structures and rotational arrangements are discussed in more detail below.

Figure 2:
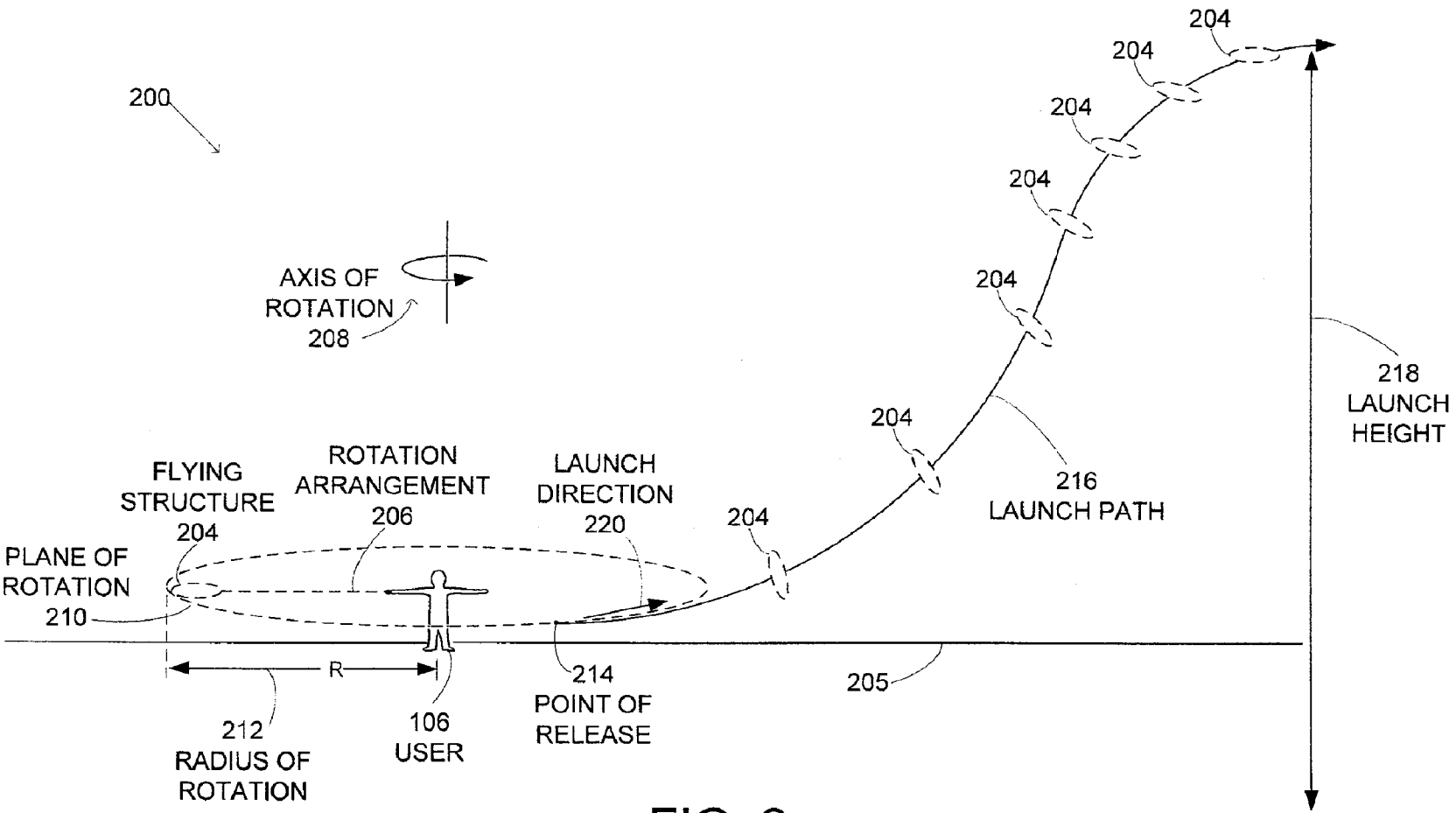
FIG. 2 is motion diagram illustrating a user initiating flight of a flying structure, in accordance with an example embodiment.

FIG. 2 is motion diagram illustrating a user 106 initiating flight of a flying structure 204, in accordance with an example embodiment. FIG. 2 is shown to include the user 106 standing on a surface 205 holding a rotational arrangement 206 that is coupled with the flying structure 204. In an example embodiment, the user 106 may rotate him or herself substantially counterclockwise (or a portion of his or her body (e.g., arm or arms)) about an example axis of rotation 208. In doing so, the user 106 may rotate the rotational arrangement 206 and the flying structure 204 counterclockwise in an example plane of rotation 210. A radius of rotation 212 between the user 106 and the flying structure 204 may form the rotational path of the rotation. The example plane of rotation 210 and axis of rotation 208 may vary in degree at any given point in time during rotation about the axes. In some example embodiments, a path of rotation forms a substantially horizontal plane.

At a point in time after the rotation of the flying structure 204 has begun, the user 106 may release the end of the rotational arrangement 206 at a point of release 214. In an example embodiment, the release of the rotational arrangement 206 is to initiate the flight of the flying structure 204. An appropriate time of release may be determined based on whether the flying structure 204 has obtained a sufficiently high velocity to achieve lift. In an example embodiment, the user 106 releases the rotational arrangement 206 when the user 106 perceives the sufficiently high velocity referred to above. FIG. 2 is shown to include a path 216 of the flying structure 204 to a launch height 218 (i.e., the distance above the surface).

In an example embodiment, a launch direction 220 of the flying structure 204 upon release may be defined by a vector forming an angle with the radius of rotation 212. A launch in a tangential direction to the radius of rotation 212 may result in a lift force being greater than a lift force resulting from a non-tangential launch. Various forces sustained by the flying structure 204 at launch may cause the flying structure 204 to launch in a non-tangential direction. Aerodynamic features of the flying structure 204 as well as the attachment of the rotational arrangement 206 to the flying structure 204 may influence the launch direction 220 of the flying structure 204. Techniques for approaching launches in the tangential direction are discussed in more detail below.

Figures 3, 4, 5:
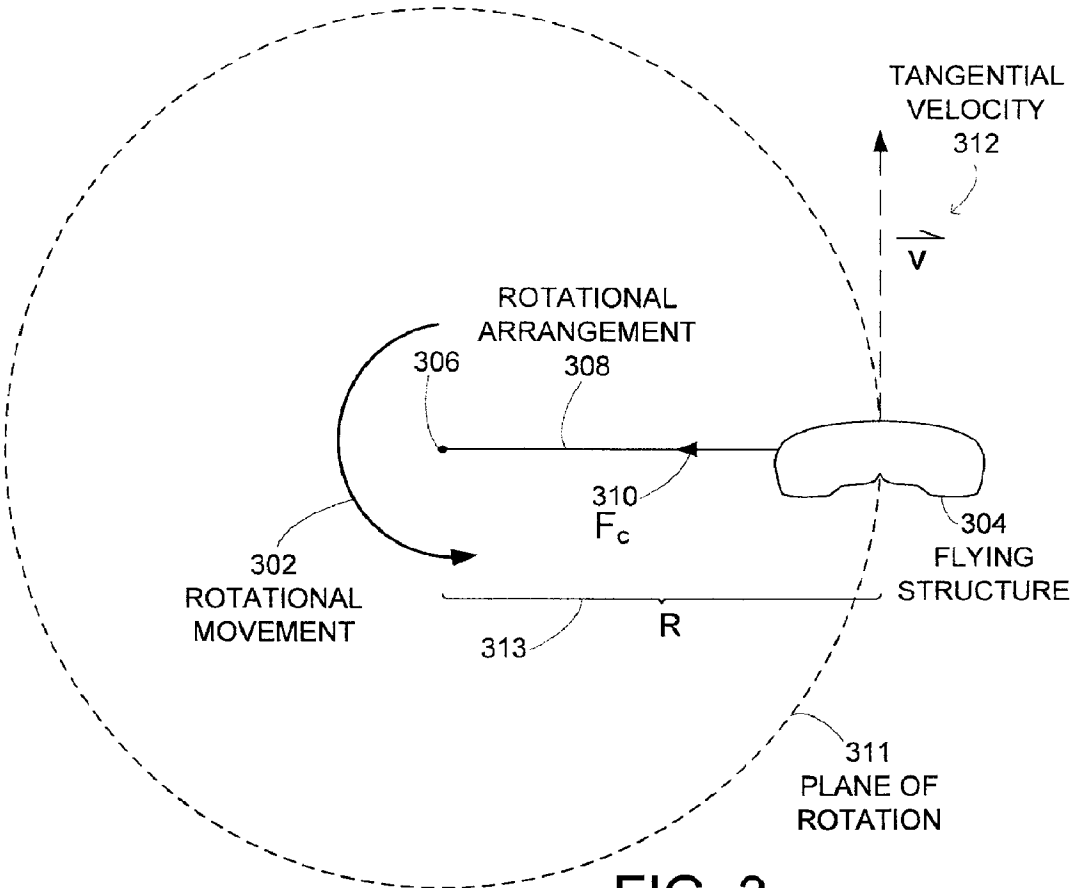
FIG. 3 is a diagram showing a model of rotational movement associated with launching a flying structure, in accordance with an example embodiment.
FIGS. 4 and 5 show equations associated with the scenarios described in FIGS. 1-3, in accordance with an example embodiment.

FIG. 3 is a diagram showing a model of rotational movement 302 associated with launching a flying structure 304, in accordance with an example embodiment. As described above, a user may rotate the flying structure 304 about an axis of rotation 306 to initiate flight of the flying structure 304. During rotation, the rotational arrangement 308 typically exerts centripetal force ($F_C$) 310 on the flying structure 304 as the flying structure 304 rotates through a plane of rotation 311.

FIGS. 4 and 5 show equations 400 and 500 associated with the scenarios described in FIGS. 1-3, in accordance with an example embodiment. The dynamic properties of this scenario may be approximated by the following:

$$\text{equation } Fc=mv^2/R \qquad 400$$

$$\text{which may be rewritten as the equation } v=\sqrt{F_C R/m} \qquad 500$$

where, $F_C$ represents the centripetal force 310 causing tension in the rotational arrangement 308;

m represents the mass of the flying structure 304;

v represents the tangential velocity 312 of the flying structure 304 along the vector ($\vec{V}$); and the variable (R) represents the radius of rotation 312 of the rotational movement 302 until the flying structure 304 is released from the rotational movement 302.

From equation 500 of FIG. 5, it stands to reason that for a fixed centripetal force ($F_C$) 310 and mass, an increase in the radius of rotation (R) would result in an increase in tangential velocity 312. Increased tangential velocity 312 at the time the flying structure 304 is released may result in increased lift forces acting on the flying structure 304 which may improve a height to which the flying structure ascends (e.g., see the launch height 218 of FIG. 2). Thus, the use of the rotational arrangement 308 to increase the radius of rotation 312 may improve the flying structure's 304 ability to climb to an altitude in a fixed period of time compared to a flying structure launched using a smaller radius of rotation 312 (e.g., a flying structure rotationally launched without a tether).

EXAMPLE FLYING STRUCTURES

FIGS. 6-11 are diagrams illustrating various flying structures 600, 700, 800, 900, 1000 and 1100, in accordance with example embodiments. The flying structure may be shaped or dimensioned in any manner that permits a lift force to act on the flying structure when it is rotated using a rotational arrangement and is subsequently propelled through the air. It may be noted that different flying structure designs may provide different aerodynamic features.

Figure 7:
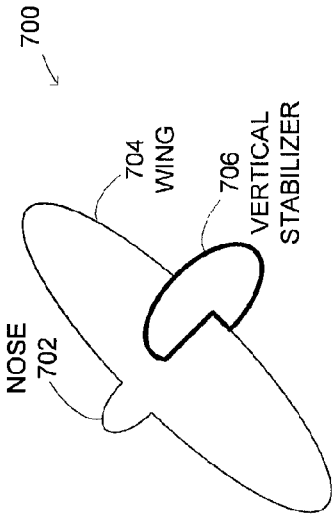
FIGS. 6-11 are diagrams illustrating various flying structures, in accordance with example embodiments.
Figure 10:
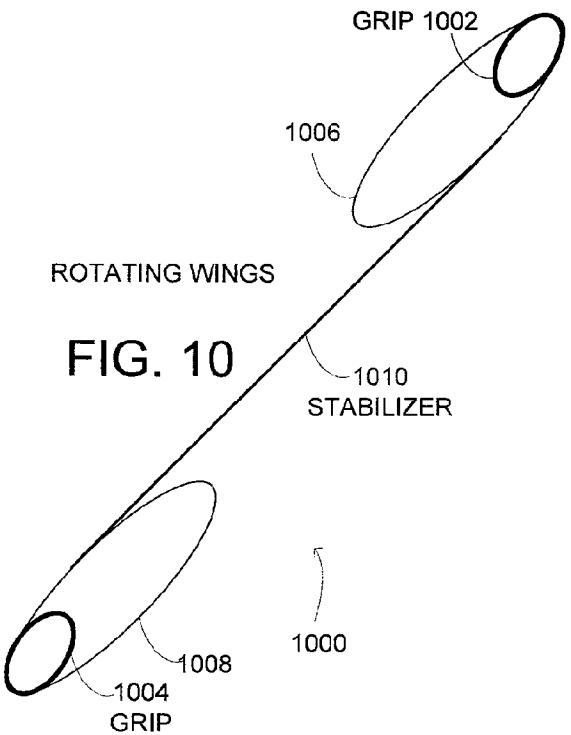
Figure 9:
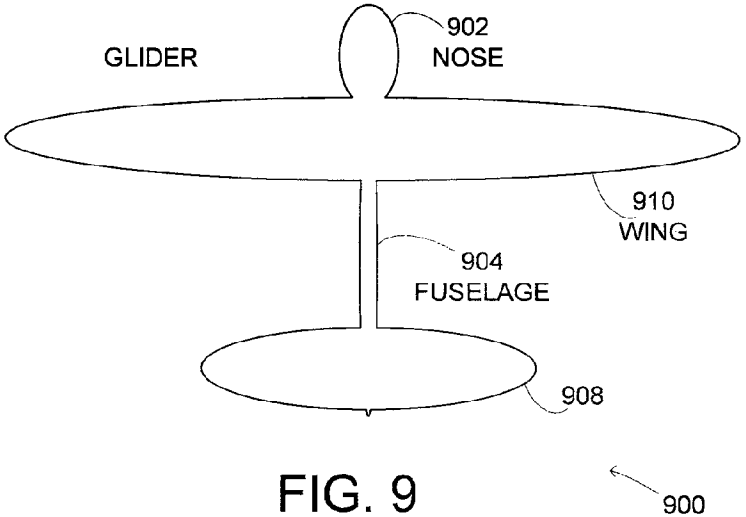
Figure 11:
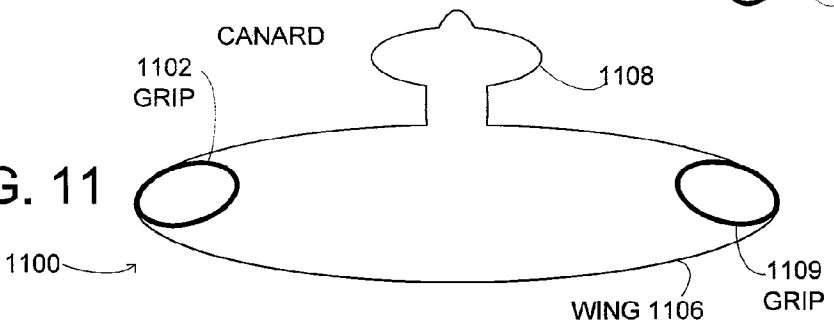

Flying structures such as the glider design 900 may include a user-grippable nose 902, a fuselage 904, and a tail assembly 908, while flying structures such as the plank wing design 700 of FIG. 7 may include a nose 702, a single wing 704, and a vertical stabilizer 706. Some example flying structures such as the canard design 1100 of FIG. 11 may integrate aspects of both the plank design 700 and glider design 900 styles of crafts. It may be noted that the canard design 1100, in addition to its plank wing 1106 and tailplane 1108, is shown to include gripping features 1102 and 1104, which may be gripped by a user handling the flying structure during launch and/or landing. The rotating wings 1000 of FIG. 10 are also shown to include the gripping features 1002 and 1004 on its stabilizer 1110 connected plank wings 1106 and 1108.

Figure 8:
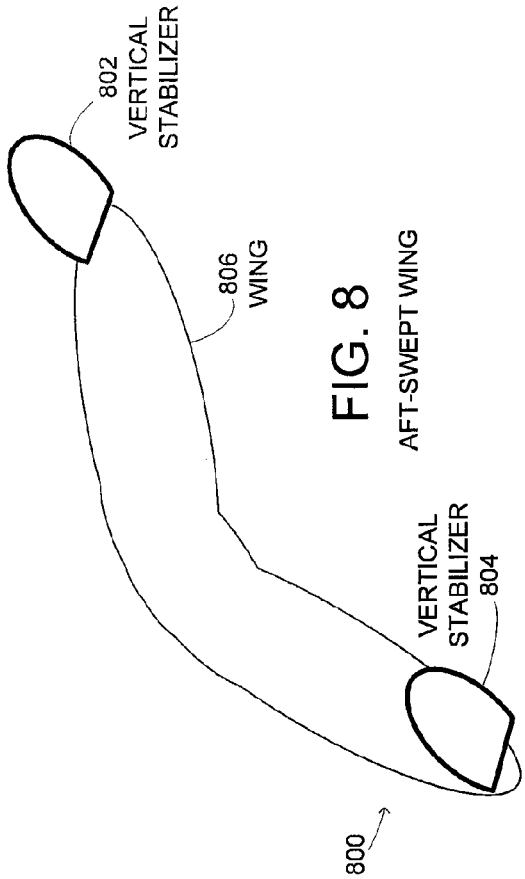
Figure 6:
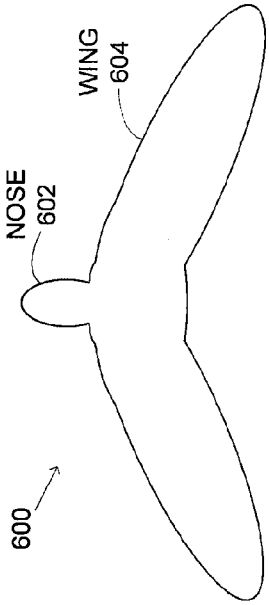

Flying structures having aft swept-wings 604 and 806 of FIGS. 6 and 8, respectively, and the rotating wings 1000 may also embody a combination of flying structure designs. It may further be noted that the aft-swept wing 806 of FIG. 8 includes vertical stabilizers 802 and 804 towards the end of the aft-swept wing 806.

In various example embodiments, flying structure such as those shown in FIGS. 6-11 may be built from materials such as foam, carbon, a rigid or semi-rigid internal skeleton covered with fabric, or any other appropriate material or combination of materials. One example material use for the plank 700 of FIG. 7 includes the monocoque technique where structural loads are supported using skin of the plank wing 700. Example skin material may include laminate, laminate reinforced with stitching, and other conforming thin films that provide suitable strength. Other flying structures such as the glider 900 of FIG. 9 may support structural loads using an internal structure such as the internal skeleton discussed above.

In some example embodiments, the configuration of the flying structure may be dependent on the activity for which the flying structure is used. For example, a flying structure such as the glider 900 of FIG. 9 typically provides a relatively large area of lifting surfaces and may require relatively low piloting skills. Accordingly, the glider 900 may suit a user who wishes to maximize flight time. Such a design may use relatively light rigid or semi-rigid material to permit structure and lift. On the other hand, the plank wing 700 of FIG. 7 may include a relatively small area of lifting surfaces and may be composed of foam or other material. Thus, the plank wing 700 may be suited for fast flying activities requiring relatively greater piloting skills to maintain flight.

Figure 12:
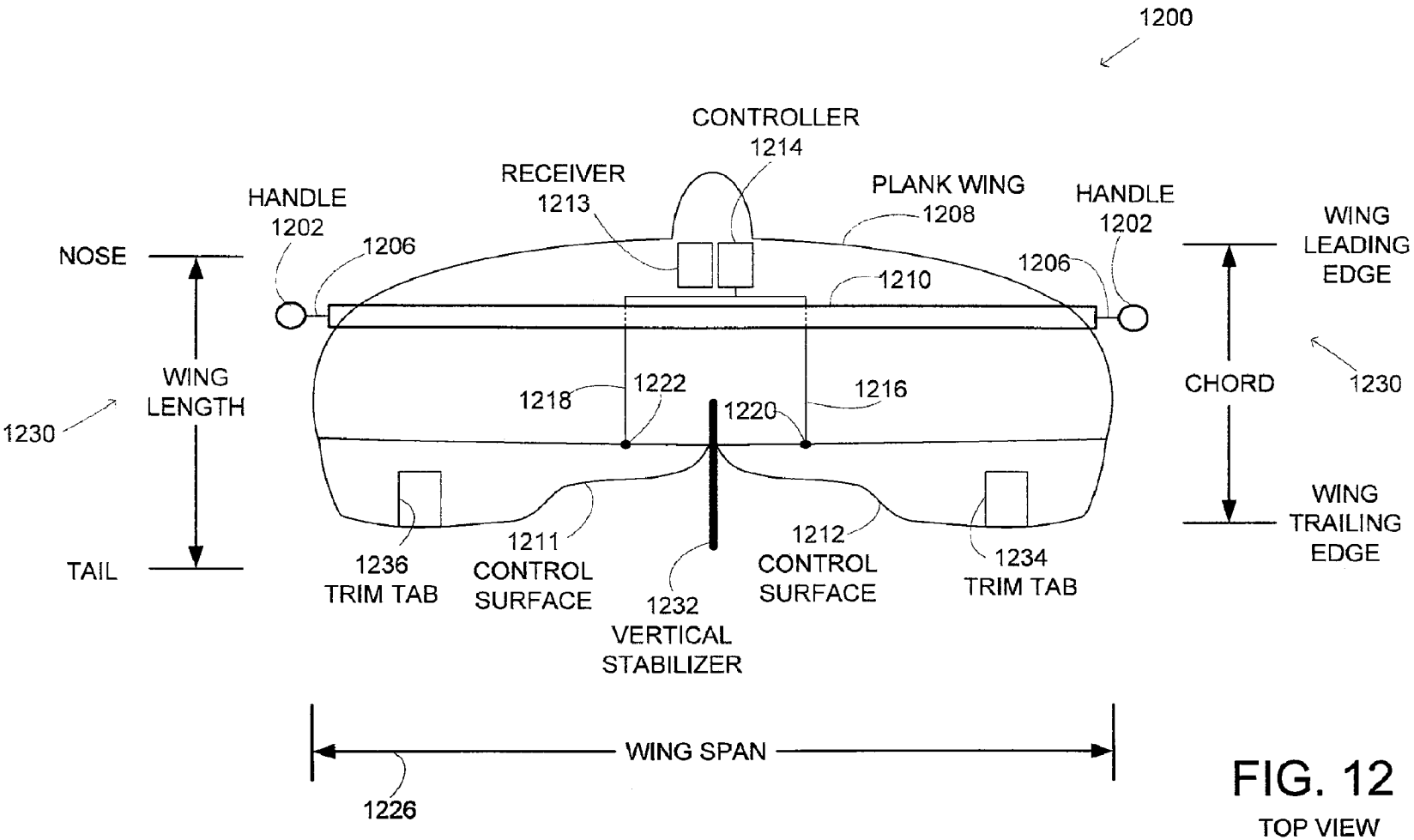
FIG. 12 is a block diagram illustrating a top view of an example plank wing, in accordance with an example embodiment.

FIG. 12 is a block diagram illustrating a top view 1200 of an example plank wing 1208, in accordance with an example embodiment. For the purposes of describing the remaining example embodiments, the terms flying structure and plank wing are used interchangeably as a plank wing is considered to be a representative flying structure.

FIG. 12 is shown to include a plank wing 1208 having a wing length 1230 and a wingspan 1226. The plank wing 1208 is further shown to include a vertical stabilizer 1232 and an example rotational arrangement 1210 that is mounted to the plank wing 1208. Although the rotational arrangement 1210 is shown to be fixedly connected to the plank wing 1208, the rotational arrangement 1210 may connect with the plank wing 1208 using other example techniques which are discussed in more detail below.

The flying structure is further shown to include control surfaces 1211, 1212. The control surfaces 1211, 1212 are surfaces of the flying structure 1208 that may be used to control different navigational aspects during flight of the plank wing 1208.

In an example embodiment, the control surfaces 1211 and 1212 may include elevators such as elevons that are to control pitch and roll of the flying structure 1208 during flight. An elevon is a mechanism typically used IN aeronautics to control pitch and roll of a flying structure.

Various example embodiments may include trim tabs 1234 and 1236 connected to the control surfaces 1211 and 1212. A trim tab is a surface coupled to a control surface whose angle relative to the control surface is adjustable to affect flight of a flying structure. In various example embodiments, the angle of the trim tabs 1234 and 1236 relative to the larger control surfaces 1211 and 1212 may be adjusted (e.g., during flight) to counteract hydro- or aerodynamic forces and to stabilize the plank wing 1208 without adjusting the control surfaces 1211 and 1212. In some example embodiments, the trim tabs 1234 and 1236 may be adjusted to set a neutral or resting position of the control surfaces 1211 and 1212, (e.g., elevator control surface).

The trim tabs 1234 and 1236 may be used during the launch of the flying structure 1208 as well as during its flight. During launch of a flying structure, a rate of ascent of the flying structure 1208 may be adjusted by tuning trim tabs (e.g., pitch trim tabs). In some example embodiments, the trim tabs 1234 and 1236 are to set to certain positions to define a neutral or default control surface position that may optimizes the rate of ascent for the launch of the flying structure 1208. Some example embodiments may include control surfaces 1211 and 1212 and/or trim tabs 1234 and 1236 whose angles or positions may be controlled by a user via a wireless remote control (discussed in more detail below). In some example embodiments, the control surfaces 1211 and 1212 and/or the trim tabs 1234 and 1236 may be manually or remotely adjusted such that the path of rotation is made to be substantially horizontal.

A receiver 1213 and controller 1214 may be mounted to the flying structure 1208. The receiver 1213 may receive radio frequency control signals from a transmitter (not shown) and send the control signals to the controller 1214 to carry out a task. The controller 1214 may receive the signal from the transmitter via the receiver 1213 and cause the control the surfaces 1211 and/or 1212 to move through a range of angles. In an example embodiment, one end of a cable 1216 is coupled to the controller 1214 and the opposite end of the cable 1216 is coupled with the control surface 1212 and a connector 1220. Likewise, one end of a cable 1218 is coupled to the controller 1214 and the opposite end of the cable 1218 is coupled with the control surface 1211 and the connector 1222. An example controller 1214 may actuate the cables to move the control surfaces 1211, 1212 to different positions.

An example structure 1208 of an example embodiment may have a span of about 900 mm and its weight may range from about 200 g to 600 g. In an example embodiment, an about 200 g flying structure 1208 may be suitable for calm airflow conditions such as indoor use. An example flying structure 1208 weighing about 600 g may be suitable for windy and/or gusty conditions or in conditions presenting the flying structure 1208 with a relatively large amount of lift. A further example flying structure 1208 weighing about 365 g may be suitable for general use and conditions falling between relatively calm and relatively windy and/or gusty.

Figure 13:
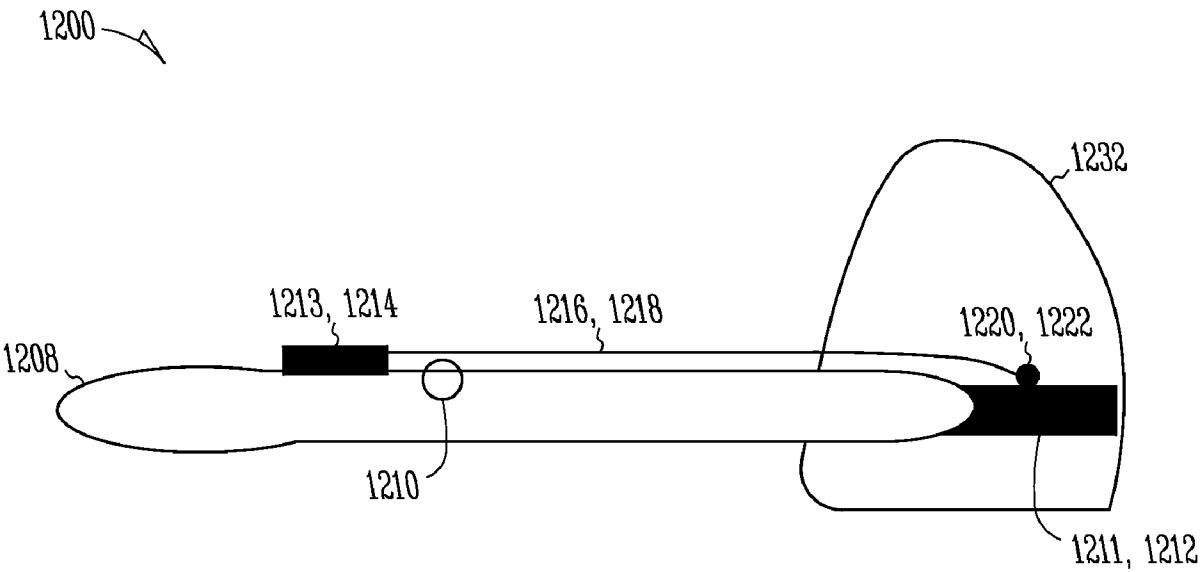
FIG. 13 is a diagram illustrating a side view of an example flying structure, in accordance with an example embodiment.

FIG. 13 is a diagram illustrating a side view 1200 of an example flying structure 1208, in accordance with an example embodiment.

In FIG. 13, the vertical stabilizer 1232 or fin may be rigidly mounted to the flying structure 1208. The fin 1232 may be configured to counteract vertical rotation (e.g., rotation about a vertical axis through the plank wing 1208). In an example embodiment, the fin 1232 extends between the two sections of the control surfaces 1211 and 1212 shown in FIG. 12. In other example embodiments, the fin 1232 may not extend between the two sections of the control surfaces 1211 and 1212. As shown in FIG. 13, the fin 1232 may be positioned so that a portion of the fin 1232 is above the top surface of the flying structure 1208 and a portion of the fin 1232 is below the bottom surface of the plank wing 1208. In an example configuration, an example fin 1232 may extend one unit below the bottom surface of the flying structure 1208 for every five units of the fin 1232 extended above the top surface of the flying structure 1308. An example plank wing 1208 having a span of about 900 mm and weighing about 350 g may use a fin 1232 with total surface area of about 220 $cm^2$ to support flight in the tangential direction at launch (see FIG. 3).

EXAMPLE ROTATIONAL ARRANGEMENTS

A rotational arrangement may permit an automatic variation in the radius of rotation of the flying structure during the rotation of the flying structure. For some example embodiments, the automatic variation is based on an adjustment or adjustments being made to a rotational arrangement during operation. In some example embodiments, the rotational arrangement is configured such that the centripetal force associated with rotation automatically adjusts the rotational arrangement.

Figure 14:
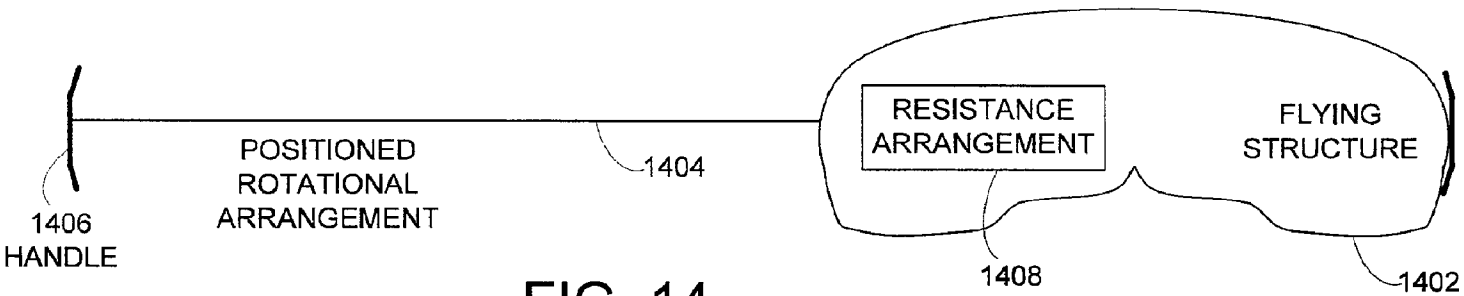

FIG. 14 is a diagram illustrating a flying structure 1402 connected with a rotational arrangement 1404 in accordance with an example embodiment. FIG. 14 is shown to include the rotational arrangement 1404 positioned such that a handle 1406 is extended from the flying structure 1402. FIG. 14 shows the rotational arrangement 1404 in the adjusted or extended position. The rotational arrangement may move into the position shown in FIG. 14 as a result of a user gripping the handle 1406 and imparting rotational movement to the flying structure 1402.

In an example embodiment, a portion of the rotational arrangement 1404 that is adjusted into position is termed an effective member (e.g., a tether). In various embodiments, the effective member may be self-contained, stored within a handle, stored within the flying structure 1402 (shown as part of resistance arrangement 1408, described below) or allowed to hang loosely. As described in more detail below, the rotational arrangement 1404 and/or the effective member may be connected to the flying structure 1402 and released from the flying structure 1402 in a variety of configurations. The effective member may include a pliable material or materials that become extended in tension sustained by the effective member that is based on the centripetal force associated with the rotation. The tension may cause the effective member to be positioned as shown in FIG. 14, such that the effective member extends between the user (not shown) and the flying structure 1402.

The effective member may include rigid components. For example, the effective member may include an example metallic telescoping member configured to telescope, and consequentially lengthen based on rotation of the flying structure 1402. The effective member may possess elastic properties allowing the pliable material to grow in length under tension so as to extend between the user and flying structure.

Figure 15:
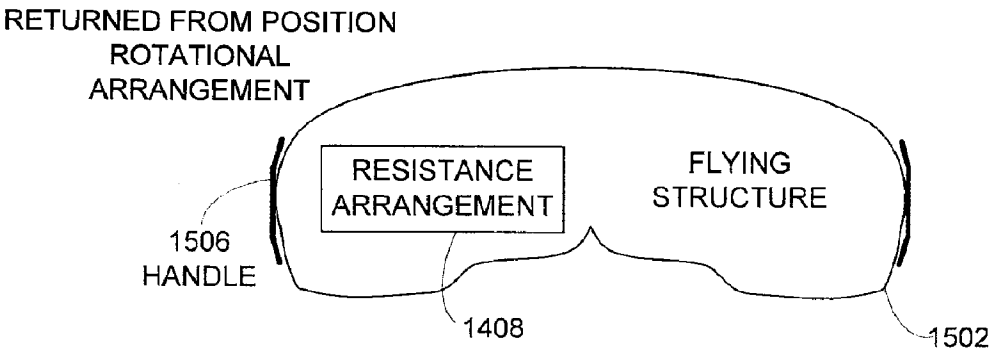
FIGS. 14 and 15 are diagrams illustrating a flying structure connected with a rotational arrangement, in accordance with an example embodiment.

FIG. 15 is shown to include the rotational arrangement in a retracted position such that the handle 1406 is shown to be contacting or nearly contacting the flying structure 1402. The configuration shown in FIG. 15 occurs, for example, when a user releases the handle 1406, relieving the rotational arrangement of tension associated with the centripetal force. In an example embodiment, such a release of the handle 1406 results in a launch of the flying structure 1402, which flies in the configuration shown in FIG. 15.

In various example embodiments, the rotational arrangement 1404 may remain with the flying structure while in other example embodiments the rotational arrangement 1404 is left with the user. Regardless, it may be appreciated that the rotational arrangement shown in FIG. 14 and shown retracted in FIG. 15 may be used ambidextrously. For example, a right-handed user may use the rotational arrangement 1404 by connecting the handle 1406 and rotating the flying structure 1402 counter-clockwise in a plane of rotation. On the other hand, a left-handed user may use the rotational arrangement 1404 by grasping the handle 1406 and rotating the flying structure 1402 clockwise in a plane of rotation. A discussion of components and design considerations associated with the rotational arrangement follow directly below.

A variety of materials may be used to fabricate a pliable material used as an effective member. An example tether may be fabricated from any tensioned fiber, elastomer, or combination thereof. Spectra, Q-Line, and Kevlar® may be considered to be appropriate because of their strength, toughness, light weight, and resistance to abrasion. Latex may be suitable as a tether material because of its ability to stretch, energy retention, and abrasion resisting properties. In an example embodiment, a tether may be made from high quality technical fiber and latex rubber.

The length of a tether at launch may be optimized depending on factors such as desired launch speeds, desired load, the properties of the flying structure, the strength of a user, etc. For an example flying wing having a span of about 900 mm, weighing about 350 g and having a fin with total surface area of about 220 $cm^2$, a suitable tether length of the rotational arrangement 1404 may range from about 150-400 cm. Tethers used for general usage flying may have a length ranging from about 170 cm-200 cm. For a range of wingspans from about 900 mm to about 400 mm a 180 cm tether may yield successful launches. Thus, a range of wingspan to tether length ratio may be appropriate for successful launches.

For the example flying wing having a 900 mm span, the tether length may be optimized for certain activities to allow for appropriate launching behavior. Tether length for urban and/or indoor usage may range from about 50-100 cm, tethers for most other general uses may range from about 100-250 cm, tether lengths for an open class of activities may reach 500 cm, and even longer launch tethers may be used.

A target rate or range of rates at which the effective member is positioned may correspond to a balance between strength of a representative user, structural reinforcement and weight of a flying structure, target launch speeds, and other factors. A rate at which the effective member is deployed may be tuned to a particular rate or rates through application of resistive forces to the rotational arrangement or its components. In various example embodiments, the resistive force may be user-adjustable, set by a manufacturer, or both.

For some example embodiments, an effective member is arranged to sustain the resistive force to affect rates at which the effective member is positioned. The magnitude of the resistive force may be based on mass of the flying structure and/or the tangential velocity of the flying structure. For example, during rotation using a pliable material, it may be appropriate to maintain a tension in the pliable material while allowing the pliable material to extend to an end-of-travel.

Figure 16A:
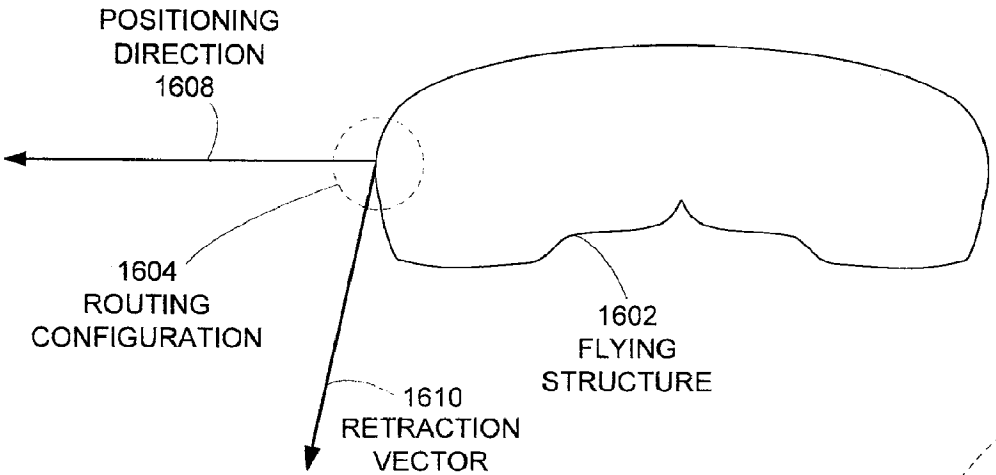
FIG. 16A is a schematic diagram showing a routing configuration, in accordance with an example embodiment.

FIG. 16A is a schematic diagram showing a routing configuration, in accordance with an example embodiment. The example routing configuration 1604 is configured to apply to a rotational arrangement, a resistive force that depends on a routing angle relative to a flying structure 1602. FIG. 16A is shown to include the flying structure 1602, the routing configuration 1604 and positioning directions 1608 and 1610 representing a direction 1608 at which an effective member may be positioned and a direction 1610 at which the effective member may be returned from being positioned.

Figure 16B:
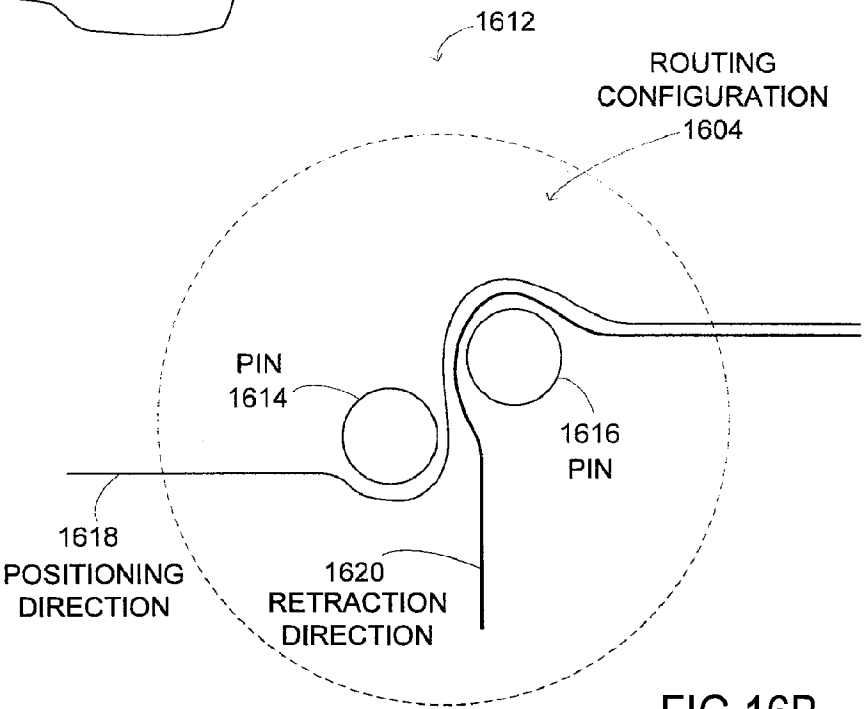
FIG. 16B is a schematic diagram showing detail of the routing configuration of FIG. 16A, in accordance with an example embodiment.

In FIG. 16B, a close-up view 1612 of the routing configuration 1604 of FIG. 16A is shown to include pins 1614 and 1616 and effective member directions 1618 and 1620. The routing configuration 1604 may be arranged such that a user may control an amount of friction applied to the effective member based on an angle at which the effective member is positioned or returned from position (e.g., retracted). For example, to achieve a higher resistance, the user may allow the effective member to be positioned at an angle that permits the effective member to contact pins 1614 and 1616. On the other hand, to achieve a lower resistance, the user may allow the effective member to be positioned at an angle that permits the effective member to contact pin 1614 but not to contact pin 1616. As a result, a magnitude of friction applied to an effective member during positioning may be smaller than the friction applied to the effective member during retraction. Of course, a user may apply any amount of friction appropriate for launch and flight of the flying structure without departing from the claimed subject matter.

Figure 17:
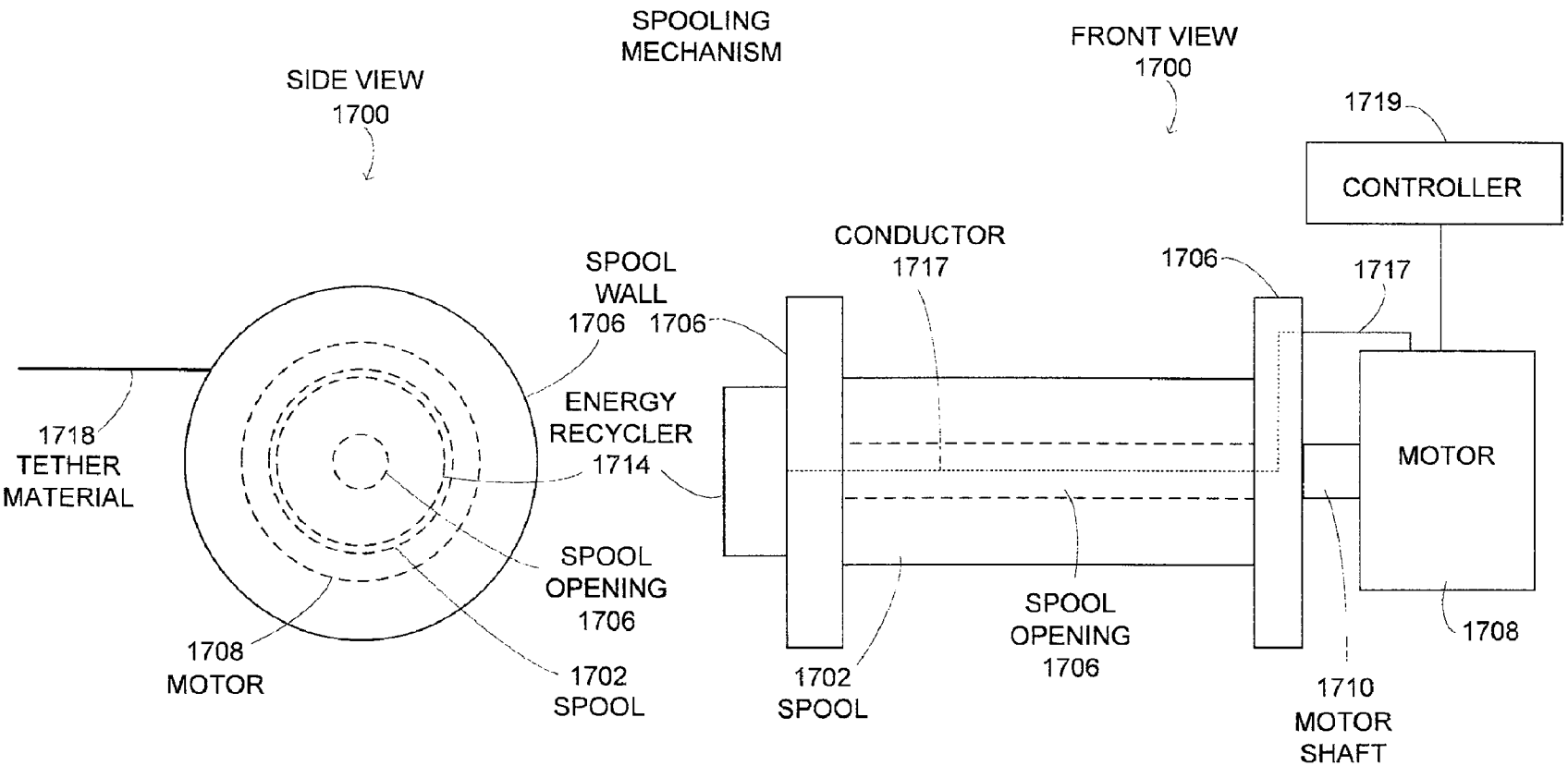
FIG. 17 is a schematic diagram showing a spooling mechanism, in accordance with an example embodiment.

FIG. 17 is a schematic diagram showing a spooling mechanism 1700, in accordance with an example embodiment. The spooling is shown to include a spool 1702 to wind pliable material 1718 (i.e., the tether material) and a spool opening 1706 to permit a motor 1708 shaft 1710 (e.g., or other actuator) to spin the spool 1702. The spool wall 1712 prevents the pliable material 1718 from spinning off of the spool 1702. In some example embodiments, the spooling mechanism 1700 may be adapted to apply resistive force by controlling a rate at which the pliable material is allowed to unwind. The spooling mechanism 1700 may use applied or mechanical friction, gears and/or motors (e.g., the motor 1708) and the like to inhibit unwinding of the spooling mechanism 1700 from a time a user begins rotating until an end-of-travel of pliable material. Retraction using the spooling mechanism is discussed below.

Figure 18:
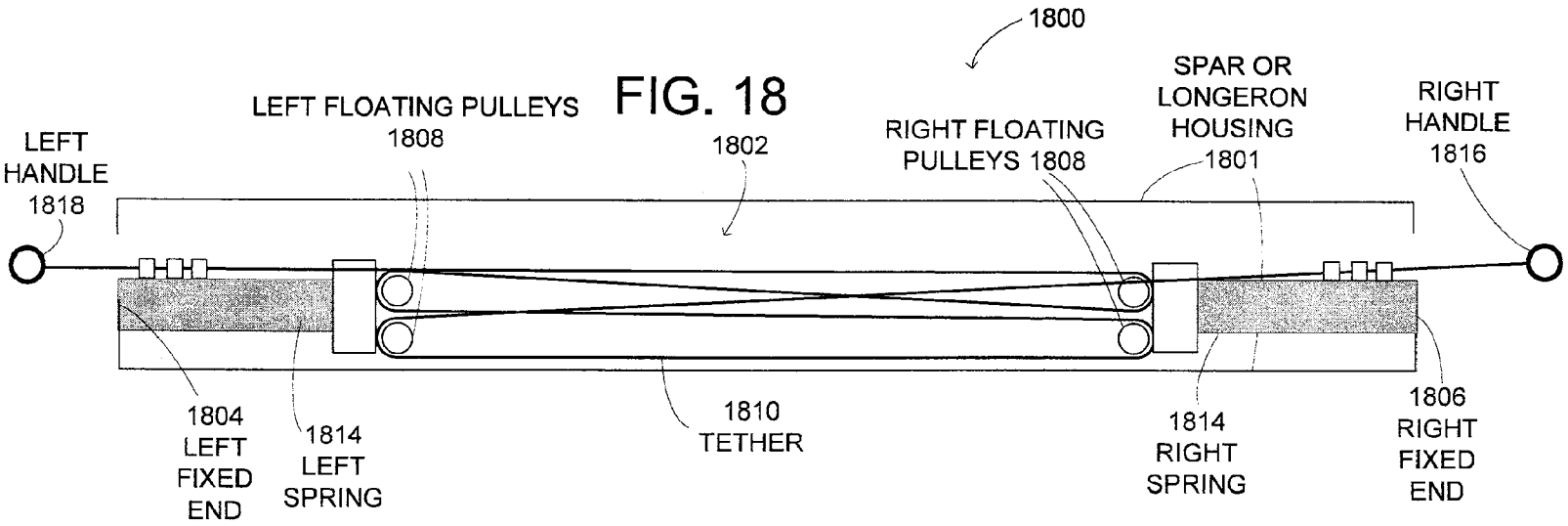
FIG. 18 is a schematic diagram showing a rotational arrangement including a Wagner block and tackle system, in accordance with an example embodiment.

FIG. 18 is a schematic diagram showing a rotational arrangement 1800 including a Wagner block and tackle system 1802, in accordance with an example embodiment. The Wagner block and tackle system 1802 is shown to include a left fixed end 1804 and a right fixed end 1806. A frictional force (e.g., a resistive force) may be applied to an effective member 1810 exiting or entering the pulley system 1802 at one or both fixed ends 1804 and 1806. The application of the friction is described with respect to FIG. 19, below. The Wagner block and tackle system 1802 is to be discussed further below with respect to retraction.

Figure 19:
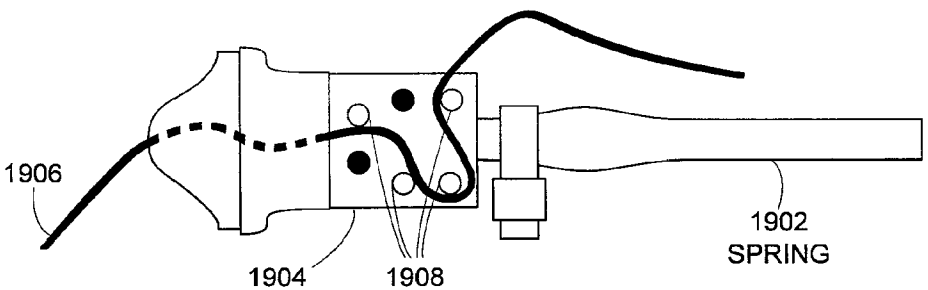
FIG. 19 shows a top view of a configuration to apply resistive force to a pliable material, in accordance with an example embodiment.

FIG. 19 shows a top view of a configuration to apply resistive force to a pliable material 1906, in accordance with an example embodiment. FIG. 19 represents a close-up view of an assembly that may exist at one or both fixed ends 1804 and 1806 of FIG. 18. FIG. 19 is shown to include an elastic spring 1902 fixedly coupled to an end cap 1904. The pliable material 1906 may be routed through a dowel pin array 1908 such that a range of frictional forces may be applied to the pliable material 1906 as it moves in and out of position in the rotational arrangement 1800 of FIG. 18. Certain pins in the dowel pin array 1908 are configured to make contact with the moving pliable material 1906 and the contact results in frictional forces that oppose the movement of the pliable material 1906 in either direction. The dowel pin array 1908 may be arranged such that the resistive force applied to the pliable material 1906 during its extension is different from a resistive force applied to the pliable material 1906 during retraction. Accordingly, the dowel pin array 1908 may be tuned to apply targeted resistive forces to the pliable material 1906 during positioning and retraction of the pliable material 1906.

An effective element may include a pliable material that possesses elastic properties. In an example embodiment, resistive forces while the pliable and elastic material are extending are generated automatically in the pliable material based on its elastic properties. In some example embodiments, an elastic material included within the rotational arrangement may absorb a force (e.g., an impulse) that would otherwise be sustained by the flying structure. One such force is an impulse that may be generated when the effective member has reached an end-of-travel (e.g., a hard stop) during positioning. For example, a relatively large force may be applied to the flying structure over a relatively short period of time when the effective member intensely jerks the flying structure and the effective member is prevented from being extended. This impulse may be more intense when a resistive force is not applied prior to the effective member reaching its end-of-travel.

Referring again to FIGS. 14 and 15, retraction may include a change of position of the rotational arrangement 1404 from the configuration shown in FIG. 14 where the handle 1406 is extended away from the flying structure 1402 to the configuration shown in FIG. 15 where the handle 1506 is close to or in conforming contact with the flying structure 1502. When a flying structure is being launched or is in flight, a retractable tether may avoid a snag (e.g., on a bush or tree), striking a person or incurring drag (e.g., aerodynamic drag) caused by a free hanging tether. Further, a user may avoid managing the rotational arrangement, when the rotational arrangement is housed with the flying structure.

A spooling mechanism may be used to retract an effective member made of a pliable material. In an example embodiment, a rotational arrangement includes the spooling mechanism 1700 of FIG. 17, which may be configured to wind up the pliable material 1718 keeping it from being extended. The motor 1708 may wind the spool 1702 responsive to user direction or responsive to a controller 1719 programmed to respond to certain input. The controller 1719 may be notified when the pliable material 1718 is no longer in tension. In some example embodiments, a load sensor (not shown) is connected with the pliable material 1718 to determine a load currently applied to the pliable material 1718 and may communicate the load information to the controller 1719. The spooling mechanism 1700 may alternatively or additionally to being powered by the motor 1708 be energized by potential energy released from a spring or coil (not shown) when the effective member is released by a user. It may be noted that a spooling mechanism other than the example spooling mechanism 1700 may be used to retract the pliable material 1718 without departing from what is claimed.

Energy generated during the positioning of the rotation arrangement may be recycled and the recycled energy may be used for various operations. In an effective member configuration that involves unwinding the pliable material 1718 during positioning, the kinetic energy may be recycled.

In FIG. 17, an energy recycler 1714 is shown to be coupled to the spool 1702 such that kinetic energy is transferred to the energy recycler 1714 when a roll of the pliable material (not shown) is unwound from the spool 1702 during the positioning of the pliable material 1718. The energy recycler 1714 may be configured to store recycled energy derived from the kinetic energy and later deliver the recycled energy for use. Some uses for the recycled energy may include powering electronics associated with the flying structure or the rotational arrangement.

The recycled energy may further be used to return the pliable material 1718 from being positioned. In an example embodiment, the spooling mechanism 1700 including the energy recycler 1714 is configured to use recycled energy to wind up the effective member from the extended position. For some example embodiments, the recycled energy is delivered to the motor 1708 via a electrical conductor 1717 and the motor 1708 uses the recycled energy to retract the pliable material 1718.

Returning to FIG. 18, the rotational arrangement 1800 is shown to include the Wagner block and tackle system 1802. The rotational arrangement 1800 may be mounted to a surface of the a flying structure, for example, within a spar or Longeron housing. The Wagner block and tackle system 1802 is a pulley system that may be used to facilitate positioning and retracting a pliable material, such as the tether 1810, from positioning. The Wagner block and tackle system 1802 includes left and right floating pulleys 1808, left and right springs 1814, and the tether 1810 acting as an effective member engaged with the pulleys 1808.

An example effective member includes a pliable material. In operation, a user may grip the left handle 1818 and begin rotating the flying structure. When the pliable material 1810 is pulled by the left handle 1818, the left and right pulleys 1808 are mechanically caused to move inward towards each other. In this example embodiment, the right handle 1816 is configured to remain stationary. When the all of the pliable material 1810 has been pulled tight, and as the pliable material 1810 is adjusted into position, the left and right pulleys 1808 begin pulling on the left and right springs 1814, respectively. The pulling of the springs 1814 may allow additional pliable material 1810 to extend between the user and the flying structure during the rotation.

The left and right springs 1814 are shown to be coupled to the left 1804 and right 1806 fixed ends, respectively. Pulling on the left and right springs 1814 may create tension in the spring material while the left handle 1818 remains extended. Accordingly, when the user releases the left handle 1818 upon release of the flying structure from rotation, the tension in the left and right springs 1814 automatically retracts the pliable material 1810 back into the flying structure such that the left handle 1818 is returned to the position it was in prior to being gripped by the user. Thus, the pliable material 1810 is associated with the one or more springs 1814 and return of the pliable material 1810 from being positioned is effected by the springs 1814 being released from a tensional force.

As described herein, in other example embodiments a rotational arrangement may include the pulley system to return the effective member from being positioned. For example, in FIG. 17, the spooling mechanism 1700 may be energized by the motor 1708 based on the controller 1719 determining in any number of ways (known independently by one skilled in the art) that the flying structure has been released from rotation.

The resistive forces discussed above with respect to positioning an effective member that is pliable may be used in a similar fashion to regulate a rate of retraction. A relatively high retraction rate may cause damage to a flying structure or upset flight in a case when a handle retracts towards and collides with the flying structure.

The motorized spooling mechanism 1700 of FIG. 17 may automatically control a wind-up rate of the pliable material 1718. The example dowel pins 1908 of FIG. 19 are shown to apply friction to the pliable material 1906, which, as explained above, may be used to regulate the retraction rate. As described with respect to FIGS. 16A and 16B, the routing configuration 1604 is configured to allow user control over the retraction rate, via frictional components by adjusting the angle at which the pliable material returns from being positioned. In some example embodiments an absorbent material may be associated with the rotational arrangement or the flying structure (e.g., mounted at area of impact) such that the absorbent material absorbs an impact force (e.g., an impulse) due to collision with a handle or moving body.

One example design constraint may include structural forces experienced by a flying structure during the initiation of flight (e.g., its launch). Referring again to the equation 400 of FIG. 4, for fixed velocity and mass, an increase in the radius of rotation (R) 312 (see FIG. 3) decreases the centripetal force 310 exerted on the plank wing 304. A flying structure such as the plank wing 304 may be designed to sustain structural stresses caused by the centripetal force 310 during the plank wing's 304 rotational movement 302. Other considerations may include providing sufficient strength and/or structure to assure that the plank wing 304 will not be destroyed when the plank wing 308 crashes into another body. For some designs the strongest forces on the flying structure may be the centripetal forces.

Referring still to FIG. 3, it may be noted that an increase in length of the radius of rotation (R) 312 may result in relatively smaller forces exerted on the plank wing 304 than experienced with a shorter radius of rotation R 312 (e.g., without a tether). Thus, negative aspects of the structural reinforcement requirement (e.g., weight, cost, etc.) may be reduced as the rotational arrangement allows extension of the radius of rotation. Regardless of the radius of rotation, the position that the rotational arrangement attaches to and/or detaches from a flying structure such as the wing, may affect the loads experienced by the flying structure during launch of the flying structure. Wing load may be defined as the weight of the flying structure 408 divided by the area of its wing.

Figure 20:
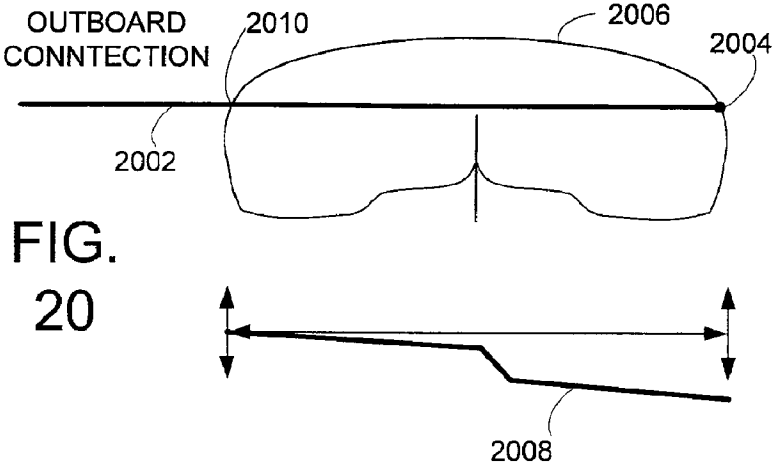
FIGS. 20-22 show schematics and graphs approximating differences between structural load distributions.
Figure 21:
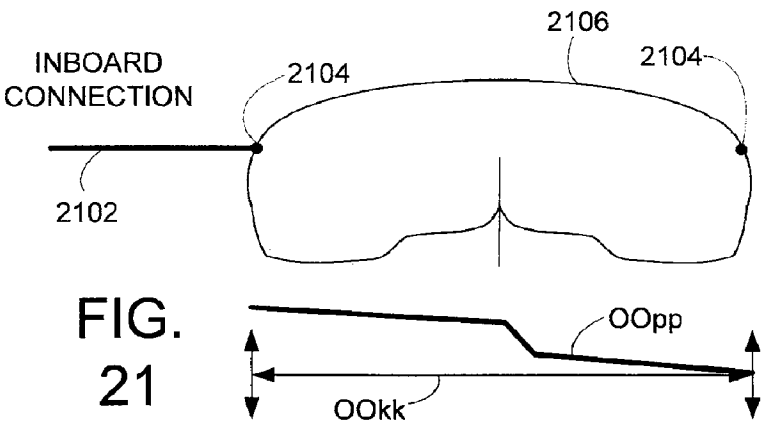
Figure 22:
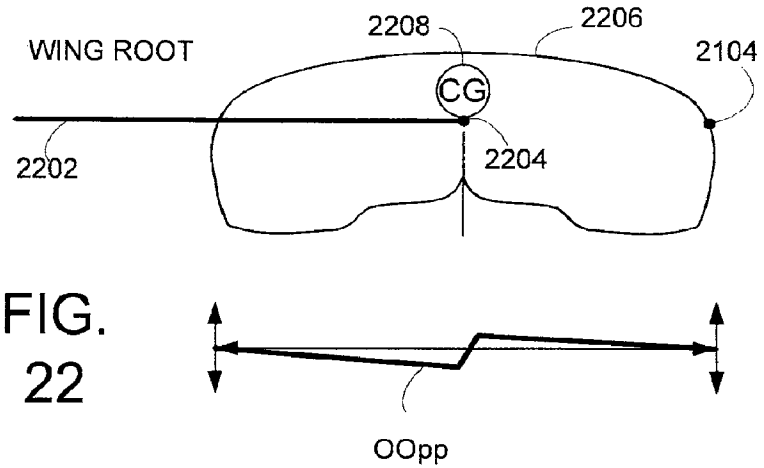

FIGS. 20-22 show schematics and graphs approximating differences between structural load distributions corresponding to the location on a wing at which centripetal force is exerted by a rotational arrangement (e.g., a tether). In FIG. 20, the tether 2002 exerts the centripetal force during rotation to the outboard end 2004 of the wing 2006. Accordingly, the distribution of forces 2008 on the wing 2006 is largest near the point of application 2004 and smallest at the axial point farthest from the point of application 2010.

In FIG. 21, the tether 2102 exerts the centripetal force during rotation to the inboard end 2104 of the wing 2106. Accordingly, the distribution of forces on the wing 2106 is largest near the point of application 2102 and smallest at the axial point farthest from the point of application 704.

In FIG. 22, the tether 2202 exerts the centripetal force to the horizontal center of the wing 808 at the horizontal center 2204 (e.g., the wing root) slightly below the wing's 2206 center of gravity (CG) 2208. Accordingly, the highest forces sustained by the wing 2206 occur near the wing root 2208 and the lowest forces are found at the in board tip 2210 and the outboard tip 2212. In an example embodiment, the location on a wing (e.g., 2204) that allows for a balance of the maximum load may be selected to optimize flight behavior and/or material selection, etc., for an example wing.

Example wings such as the wings may experience wing loads under certain conditions ranging from about 1100-2300 $g/m^2$. An example wing having a span of about 900 mm, weighing about 365 g and having a wing area of about 0.23 $m^2$ may yield a wing load of about 1,560 $g/m^2$.

During rotation and while in flight, the wing 308 of FIG. 3 may experience rotation about the wing's 308 vertical axis (e.g., adverse yaw). As discussed above, the flying structure may include a vertical fin to counteract this rotation. The length of radius of rotation in FIG. 3 may affect the rotation of the wing 308 about its vertical axis. For a given launch speed, an increase in the radius of rotation corresponds to a smaller rotational moment acting on the wing 308. Accordingly, an increase in length of the radius of rotation may result in relatively a smaller rotational moment acting on the wing 308 than experienced with a shorter radius of rotation (e.g., when a rotational arrangement is not used). Thus, relatively sizable and/or bulky vertical stabalizers (e.g., weight, cost, etc.) may be avoided as the tether 306 extends the radius of rotation.

Figure 23:
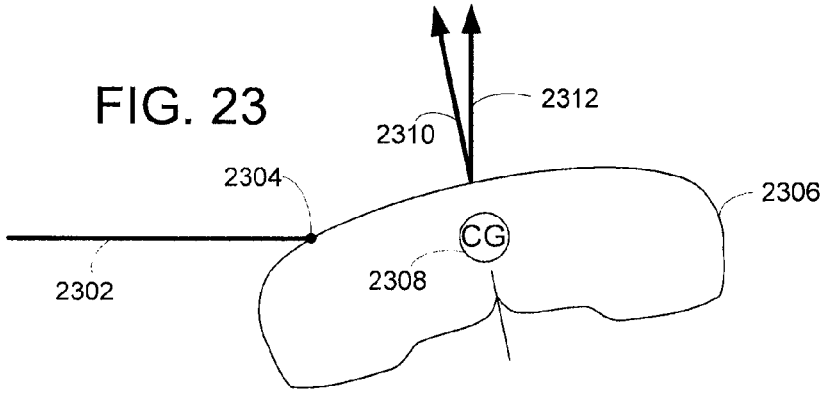
FIGS. 23-25 are diagrams illustrating different rotational forces imparted on a wing at the time of launch.
Figure 24:
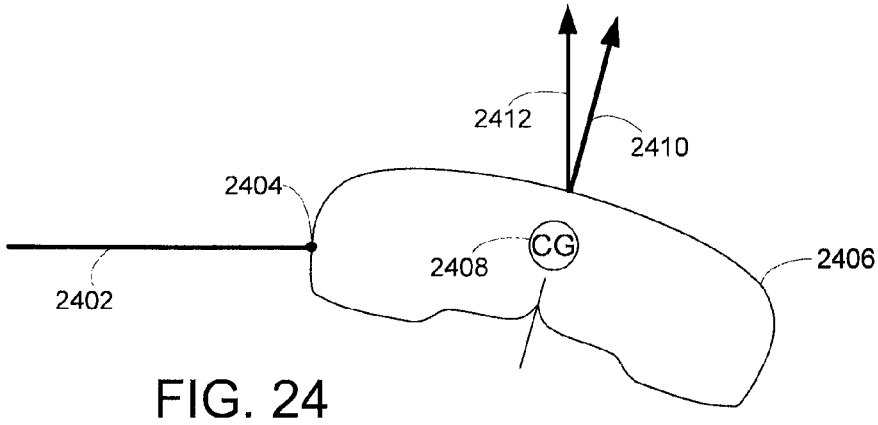
Figure 25:
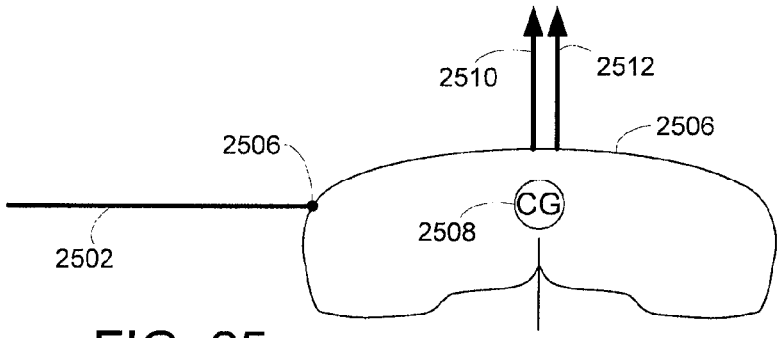

FIGS. 23-25 are diagrams illustrating different rotational forces imparted on a wing at the time of launch, in accordance with example embodiments. In various example embodiments, the rotational forces imparted on a wing may depend in part on a location at which a tether exerts a force on the wing.

In FIG. 23, a tether 2302 is coupled to the wing 2306 at a position 2304 near the top of the CG 2408 as measured vertically from the CG 2308. Consequently, a moment is created causing the CG 2308 to rotate about a vertical axis away from the tangential direction 2312 and to point in a direction 2310.

Conversely, in FIG. 24, because the tether 2402 is coupled to the wing 2406 at position 2404, a moment may be created causing the CG 2408 to rotate about the vertical axis, away from the tangential axis 2412 and to point in a direction 2410.

In FIG. 25, the position at which the tether 2502 is coupled to the wing 2406 may appropriate to minimize a resulting moment and effectively align the direction 2410 of the CG 2508 with the direction of the tangential axis 2512. In some example embodiments, coupling the tether at the wing tip may bias a flying structure to a horizontal orientation, with the lift vector perpendicular and providing maximum lift.

Various example techniques for connecting a rotational arrangement with a flying structure are described below. In an example embodiment, a structural anchor, end-of-travel limiter or a point sustaining the tension force may be located at a location on the wing 2308 such as at a point inline with the CG of the craft, at the root of a wing or some other point on the wing. An example exit point for the tether may be optimized at or near a wingtip in order to bias the structure towards a horizontal orientation during rotation.

Figure 26:
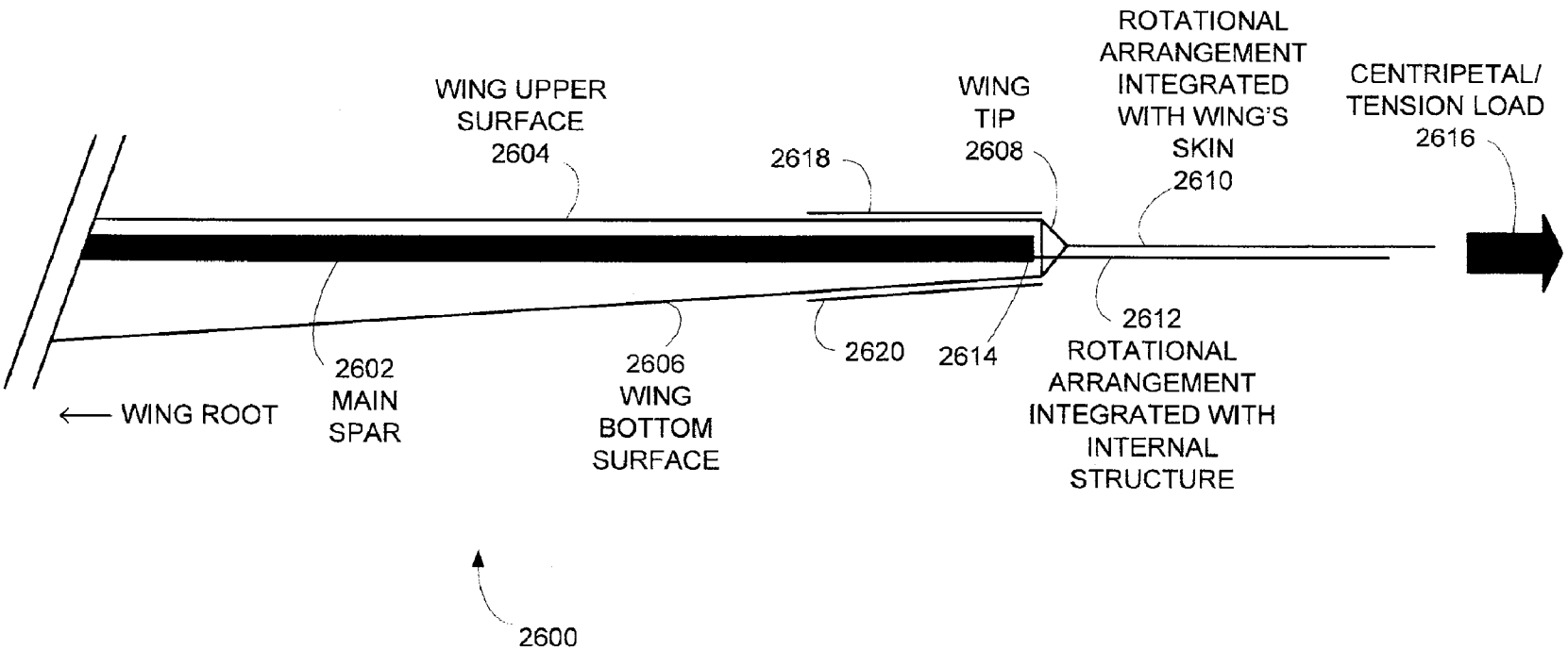
FIG. 26 is a schematic diagram illustrating multiple techniques for connecting rotational arrangements to a wing, in accordance with example embodiments.

FIG. 26 is a schematic diagram illustrating multiple techniques for connecting rotational arrangements to a wing, in accordance with example embodiments. FIG. 26 is shown to include a left wing 2600 having a main spar 2602, an upper surface 2604, a bottom surface 2606 and wing tip 2608. During rotation of the wing 2600 in preparation for launch, a tether such as 2610 or 2612, under tension 2616 between the wing 2600 and a user may exert the load 2616 on the wing 2600.

The tethers 2610 and 2612 are shown to be fixedly coupled with the wing 2600 such that at least a portion of the tethers 2610, 2612 are to remain with the flying structure following release of the flying structure from rotation.

In an example embodiment, the tether 1204 may be connected with the internal structure (e.g., the spar 2602) of the wing 2600. A wing's spar 2602 may be designed to nearly intersect with a flying structure's CG. Referring again to FIG. 25, it is to be noted that a launch system may be kinematically balanced by locating the tether's connection point 1102 on the wing 2506 in the path of a horizontal line running through the CG 2508. Thus, the example connection point 2614 on the spar 2602 may allow for kinematic balance during rotation with respect to a vertical axis through a flying structure. In some example embodiments, the connected point 2614 may include a connection over the surface area of the spar 2602. In an example embodiment, the spar 2602 may be a significant structural component of the wing 2600 and the coupling of the tether 2612 with the spar may be suitable for bearing rotational loads (e.g., the loads exerted by the tether when in tension).

In some example embodiments, the rotational arrangement 2610 may be connected with the wing 2600 so as to distribute the load 2616 to multiple portions of the flying structure 2600. For example, the tether 2610 may be connected with the wing 2600 by distributing multiple connection points over surface area 2618, 2620 of the wing's 2600 skin. For inflatable flying structures or those having flat membrane wings, the skin's surface area (e.g., 2618, 2620) may provide a suitable anchor (e.g., alone or in combination with a structural connection) for the tether 2610 during rotation and under tension.

Figure 27:
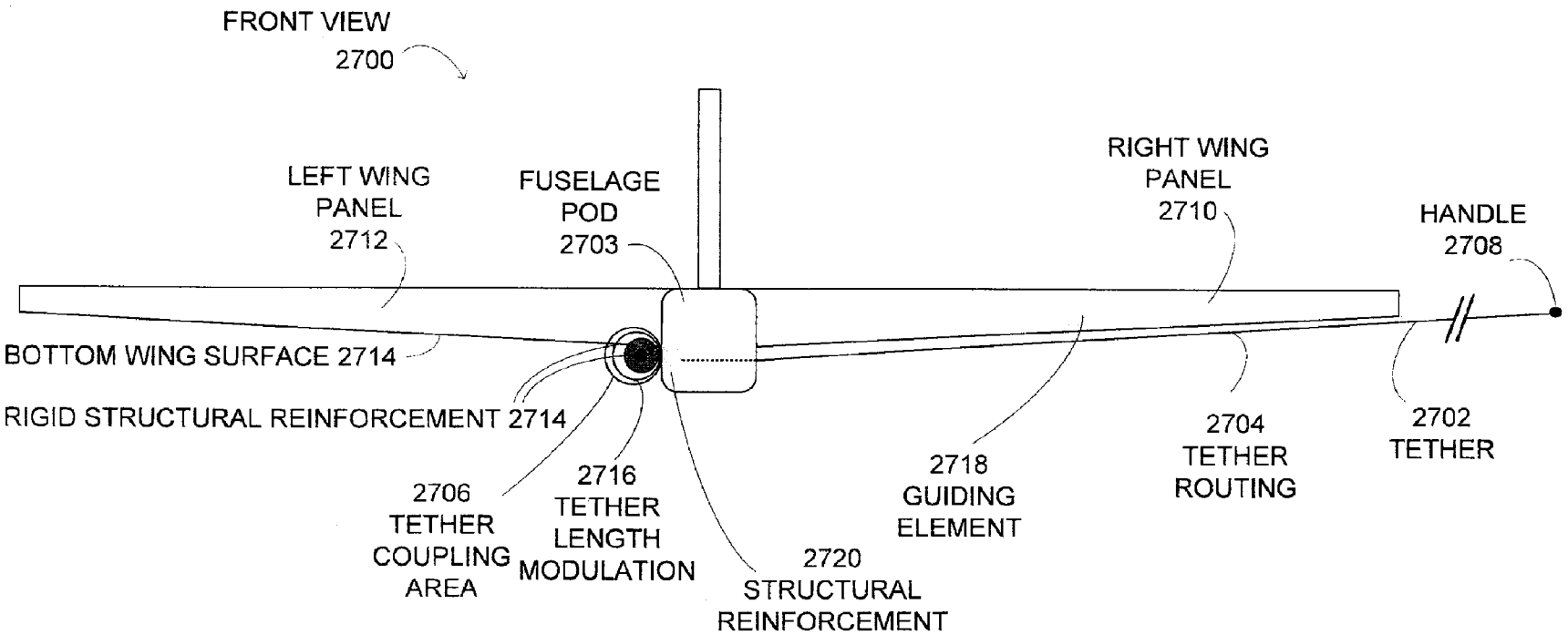
FIG. 27 is a schematic diagram illustrating a technique for routing and attaching a rotational arrangement, in accordance with an example embodiment.

FIG. 27 is a schematic diagram illustrating a technique for routing and attaching a rotational arrangement, in accordance with an example embodiment.

FIG. 27 shows a front view of a flying structure 2700 connected with a tether 2702, in accordance with an example embodiment. The tether 2702 is shown to include a handle 2708 on one end and shown to be routed through a tether routing 2704 where the tether 2702 is coupled to the flying structure 2700 at a coupling area 2706 near a fuselage pod 2703. It is to be noted that the coupling area 2706 is positioned at the wing root to balance loads caused by tension in the tether during rotation as described with respect to FIGS. 20-22 above.

The example tether 2702 may be made of a pliable material such as string and may not be retractable so that the user 106 in FIG. 2 may simply release the handle 2708 at the point of release 212 of FIG. 2 to launch the flying structure 2700. The example handle 2708 may be formed by a knot at the end of the tether 2702. Using a lightweight knot as the handle 2708 may allow the flying structure 2700 to tolerate the knotted string for example hanging from its right wing panel 2710 or left wing panel 2712 during flight.

In FIG. 27, the tether routing 2704 may provide strain relief for the structure surrounding the coupling area 2706. The guidance of the tether along the bottom wing surface 2714 may distribute the forces exerted by tether tension across the surface area of the wing. An adhesive or lightweight and appropriately shaped guiding element 2718 may be used to guide the tether 2702 between the wing tip and the coupling area 2706.

The coupling area 2706 may include a load spreader 2714 that may distribute the load upon the coupling 2706. The example load spreader may include approximately two-inches in length of lightweight wood, carbon fiber that may be attached with the tether 2702. The tether 2702 may be tied and/or wrapped around the length of material and may distribute the load across the length. Of course, other lengths and materials may alternatively or additionally act as a load spreader. Additional structural reinforcement 2720 such as fiber, film, or any other appropriate rigid material may be provided around the area of attachment to protect the flying structure 2700.

The example tether 2702 may allow an effective member such as a tether to be adjusted with a tether length modulator 2716. In an example embodiment, a length of the tether 2702 that is not used to lengthen the radius of rotation (see FIG. 3) may be wound around the object (e.g., a length of wood or any other spool) or otherwise taken up and stored on the flying structure 2700.

In various example embodiments, the flying structure and the rotational arrangement are configured to house the rotational arrangement within the flying structure. When the rotational arrangement is for example, included within the flying structure, the effective member may be stored within the flying structure and be configured to extend between the flying structure and the user during rotation.

Referring again to FIG. 17, in one example, the spooling mechanism 1700 may be included within the rotational arrangement, which may in turn be housed within a flying structure. As described above, the spooling mechanism 1700 may be employed within the flying structure to automatically extend and retract the effective member 1718 portion of the rotational arrangement as describe herein. Another example of housing the rotational arrangement in a flying structure is the housing of a rotational arrangement that includes a pulley system such as the Wagner block and tackle system 1802 of FIG. 18. Regardless of whether a spooling mechanism, a pulley system, or any other technology is housed in the flying structure, the example embodiment may include a handle that is arranged to conform with the flying structure once the effective member retracts to an unextended position.

Handles associated with a rotational arrangement may be shaped to fit a hand or other means of grasping. Example handles may be ergonomically designed for comfort and to help a user create rotation. Handles may also be designed to minimize drag if the handle remains hanging from the flying structure after the tether is released. Further, a handle that retracts into flying structure during flight may be designed to minimize adverse affects on flight (e.g., a handle that upsets balance of the structure and causes the flying structure to rotate).

In some example embodiments, a rotational arrangement is configured to release from the flying structure at the point of release (see FIG. 2), and be retained by the user initiating the launch (e.g., the tether may be detachably coupled to the flying structure). Alternatively or additionally, a rotational arrangement may be operationally disconnected from the rotational arrangement to allow release of the flying structure from rotation. Various handle embodiments may be employed to implement the above described release modes and provide additional functionality.

Figure 28:
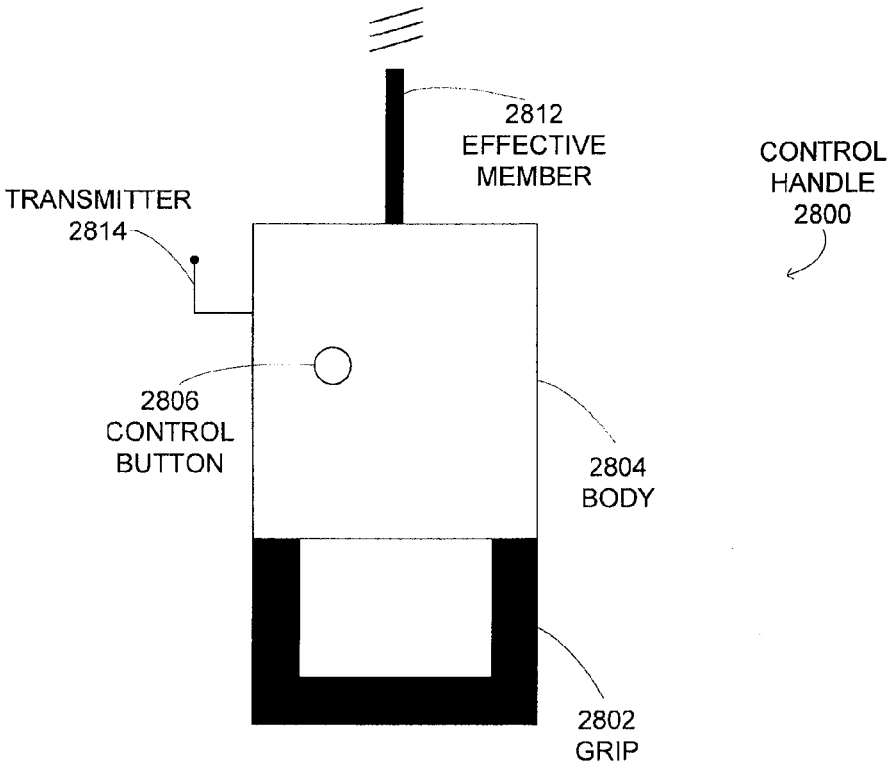
FIG. 28 is a block diagram showing a control handle, in accordance with example embodiments.

FIG. 28 is shown to include a control handle 2800, in accordance with example embodiments. The example control handle is shown to include a grip 2802, for securing the control handle 2800 manually while rotating a flying structure. A body 2804 may include a mechanism such as a spring-loaded actuator to mechanically release a secured end portion of an extended effective member 2812. In an example embodiment, a user may actuate the actuator by pressing a control button 2806 to release a loop knot previously fastened by the user in a fastening device (not shown) housed within the example control handle 2800. In some example embodiments, quick release mechanism alone may be used for fastening and manual release of the effective member. Such mechanisms may include archer's quick release, snap shackles, or any such mechanism.

In some example embodiments, the control handle 2800 is configured to automatically disconnect a rotational arrangement from the user and/or from a flying structure, based on sensing a specific tensional force sustained at portions of the rotational arrangement. For example, the body 2804 of the control handle 2800 may contain a tension sensor (not shown) and a controller (not shown) such as circuitry or software for implementing logic functions. The example control handle 2800 may be configured to release the flying structure from an effective member based on the tension sensor signaling to the controller that a tension being applied to the handle has exceeded a threshold number of, for example, Newtons.

Alternatively or additionally, the control handle 2800 may automatically release the rotational arrangement from the control handle 2800 and/or from the flying structure based on a position of a portion of the rotational arrangement. In an example embodiment, the control handle 2800 houses a wireless transmitter 2814, a position sensor (not shown), a controller, and a effective member 2812 that extends from the control handle 2800 during rotation of the flying structure. The example control handle 2800 may use the position sensor to signal the controller when the effective member 2812 has extended to a length that exceeds a specific threshold length. Upon receiving the signal, the example control handle 2800 may initiate the release of the effective member 2812 from the flying structure via a wireless signal. In the example embodiment, the flying structure includes a receiver communicatively coupled to an onboard actuator that releases the rotational arrangement responsive to the received wireless signal.

It may be noted that the release techniques described above that automatically release a rotational arrangement may be implemented by actuators, sensors and control logic, and wireless transmitters at locations other than the handle. For example, the automatic release features may be implemented by hardware and/or software located on a flying structure.

In some examples, the control handle 2800 includes the spooling mechanism discussed above with respect to FIGS. 16A and 16B. The control handle 2800 may be configured to allow the effective member to extend during rotation and automatically retract the effective member following release of the flying structure from rotation. In an example embodiment, the automatic release of the effective member from the flying wirelessly initiated by the control handle 2800, based on exceeding a threshold value associated with the rotational arrangement.

Figure 29:
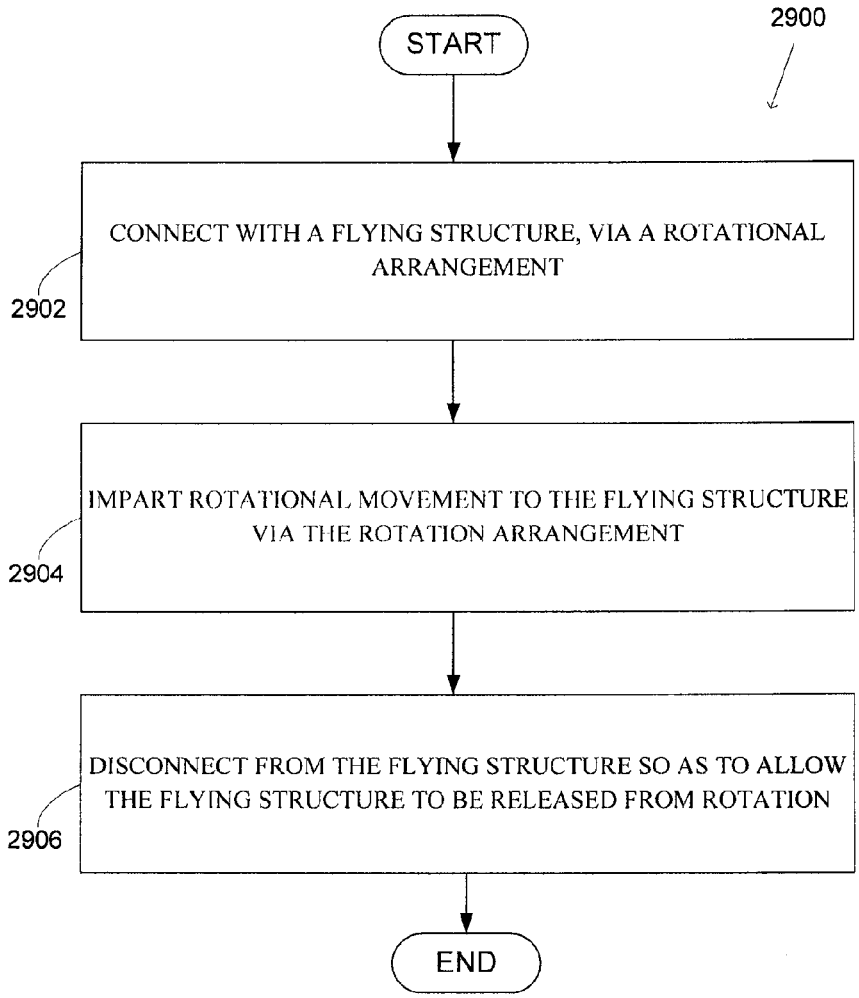
FIG. 29 is a flow diagram showing a method for initiating flight of a flying wing, in accordance with an example embodiment.

FIG. 29 is a flow diagram of a method for initiating flight of a flying wing, in accordance with an example embodiment. At block 2902, the method 2900 is shown to include connecting with a flying structure, via a rotational arrangement. A user may connect with the rotational arrangement as simply as inserting his or her finger in a loop knot of a pliable material that is also connected with the flying structure.

At block 2904, the method 2900 is shown to include imparting rotational movement to the flying structure via the rotation arrangement. Referring again to FIG. 1, the initiation of the flight of the flying wing 104 is shown as the user 106 rotates the flying structure 104 with the pliable material 114. The rotation is shown to cause a tension in the pliable material 114 such the pliable material 114 is extended between the user 106 and the flying structure 104. In some example embodiments, the user 106 may use preset or dynamically adjusted control surfaces and/or trim tabs to rotate the flying structure in a targeted plane of rotation (e.g., a horizontal plan).

At block 2906, the method 2900 may include disconnecting or releasing from the flying structure so as to allow the flying structure to be released from rotation. For the user connected to the loop knot, the user may let go of the pliable material and, in some examples, the pliable material launches with the flying craft and trails, for example from the wing of the flying structure.

Once the flying craft has been launched, a transmitter may be used to manipulate control surfaces (e.g., elevons) that may be coordinated to control pitch and roll of the craft during flight. The transmitter may communicate wirelessly with a radio receiver powered by a battery and housed, for example within a fuselage pod.

Figure 30:
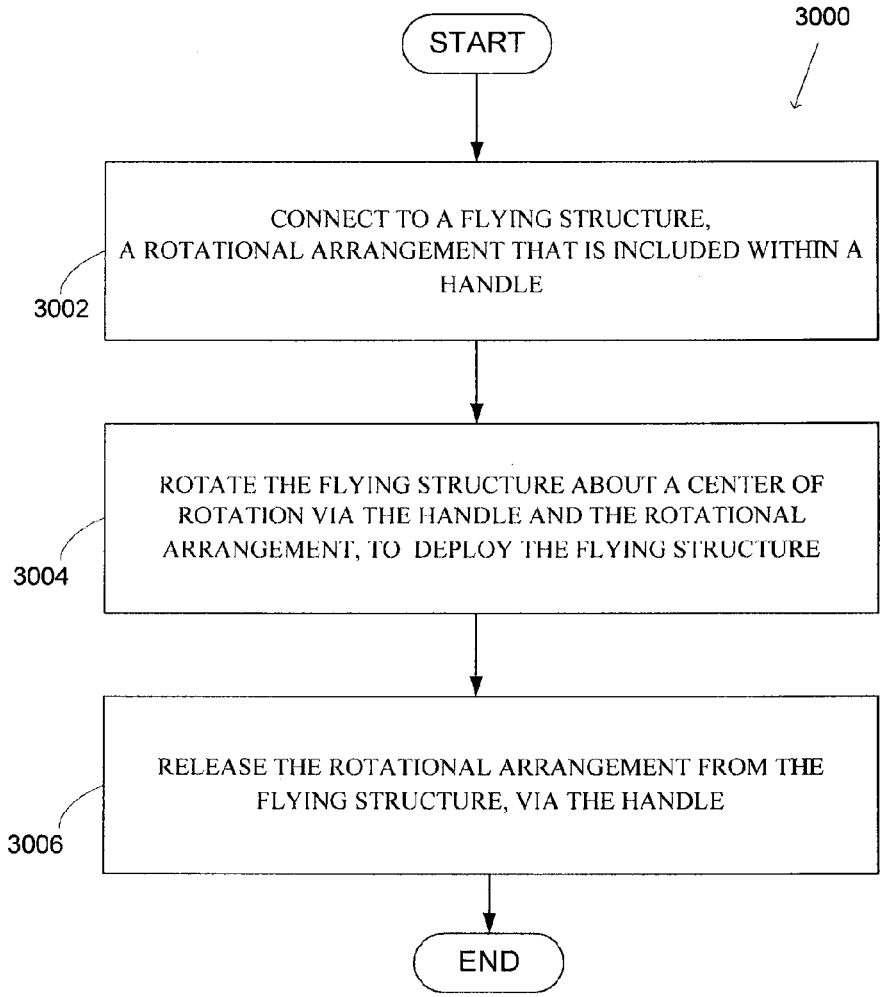
FIG. 30 is a flowchart showing a method for releasing a rotational arrangement from a flying structure, in accordance with an example embodiment.

FIG. 30 is a flowchart showing a method 3000 for releasing a rotational arrangement from a flying structure, in accordance with an example embodiment.

At block 3002, the method 3000 is shown to include connecting a rotational arrangement with a flying structure, wherein the rotational arrangement is included within a handle. In some example embodiments, the user may removeably couple the rotational arrangement to the flying structure. Appropriate fasteners may include those that may fasten to a feature on the flying structure and permit unfastening via remote signal. Various quick release style mechanism enhanced to include or receive a releasing actuator may be used to fasten and unfasten with the flying structure. The control handle 2800 of FIG. 28 may be used to house the rotational arrangement in some example embodiments. In some examples, a pliable material may simply be stuffed or otherwise arranged in the control handle.

At block 3004, the method 3000 is shown to include rotating the flying structure about a center of rotation, via the handle and the rotational arrangement, wherein the rotation deploys the rotational arrangement. Continuing with the examples above, the extension of the pliable material may be affected by applied resistance forces. For example, the control handle and/or the rotational arrangement itself may include the routing arrangement 1604 described with respect to FIGS. 16A and 16B to allow the user to vary the resistive force applied to the pliable material during extension and retraction.

At block 3006, the method 3000 is shown to include releasing the rotational arrangement from the flying structure, via the handle. Techniques for release described herein may be used to release the rotational arrangement from the flying structure. In one embodiment, a user signals for release using the wireless capabilities of the control handle 2800 in FIG. 28.

In the practice of the embodiments described above, significant weight penalties may be avoided with respect to the flying structure in the case that the rotational arrangement remains with the handle because the flying structure does not need to bear the weight of rotational arrangement during flight. Weight savings of this nature may be appropriate for certain weather conditions or for low-mass flying structures. For example, a flying structure that does not include the rotational arrangement may be properly used despite weather conditions that do not favor a heavier flying structure.

Figure 31:
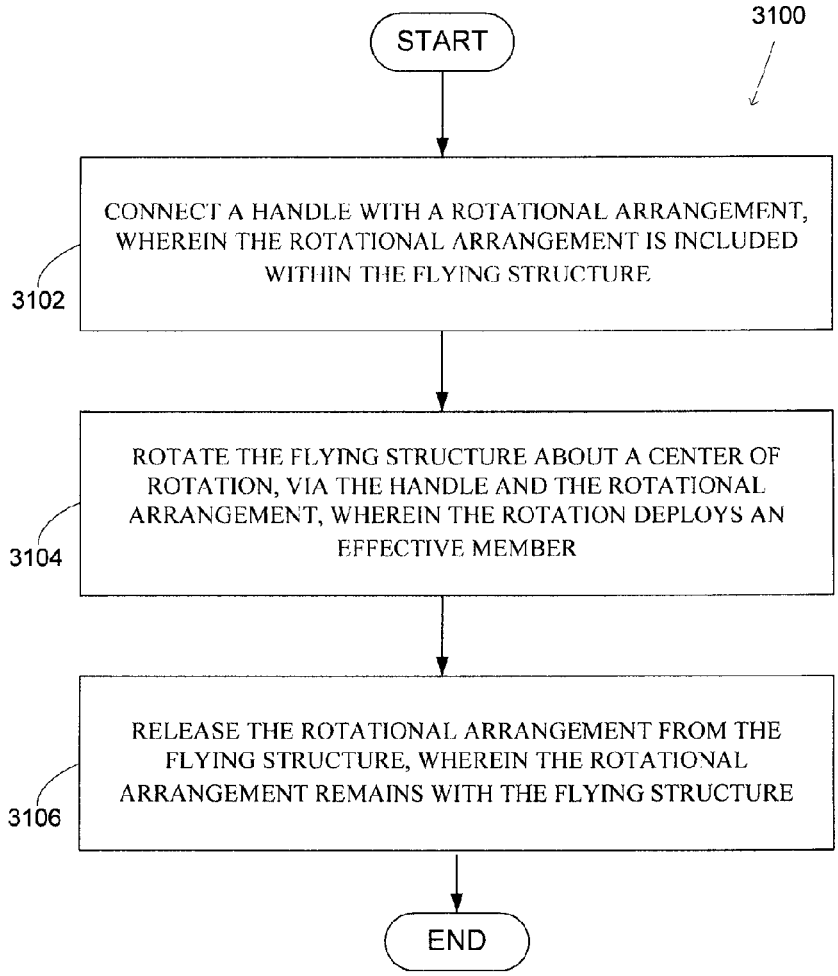
FIG. 31 is a flowchart showing a method for releasing a rotational arrangement from user, in accordance with an example embodiment.

FIG. 31 is a flowchart showing a method 3100 for releasing a rotational arrangement from user, in accordance with an example embodiment. At block 3102, the method 3100 is shown to include connecting a handle with a rotational arrangement, wherein the rotational arrangement is included within the flying structure.

At block 3104, the method 3100 is shown to include rotating the flying structure about a center of rotation, via the handle and the rotational arrangement, wherein the rotation deploys an effective member.

At block 3106, the method 3100 is shown to include releasing the rotational arrangement from the flying structure, wherein the rotational arrangement remains with the flying structure.

The handle may include grippable shape such as a hand fitting ball. In an example embodiment, the user may release the rotational arrangement by releasing the ball at the point of a flying structure's release from rotation. Following user release of the ball, an effective member may for example, retract towards the flying structure. For some example embodiments, the rotational arrangement and/or the example ball may be configured to allow release of the ball from the rotational arrangement such the ball falls away from the flying structure. In one example, the ball may be released at a particular altitude that has been reached by the flying structure.

In other example embodiments, the spool mechanism of FIGS. 16A and 16B or the Wagner block and tackle system of FIG. 18 may retract the user-released effective member into the flying structure following release. The handle released by the user may retract into or close to the flying structure on retraction of the effective member. In some embodiments, the handle conforms with the flying structure in the retracting position (see the handle 1202 of FIG. 12) so as to conform with the aerodynamic design of the flying structure.

When the rotational arrangement is housed in the flying structure, a user is relieved from managing the arrangement. For some users, it may be appropriate to be free from carrying or handling the rotational arrangement. For example, such practice may be suitable for a relatively weak or uncoordinated user. A control handle type of device may not be necessary when the flying structure is launched by a handle that retracts into the flying structure, which may further simplify the launch and post launch process.

In yet a further mode of release, a user may release the handle from the rotational arrangement such that the handle remains with the user and the rotational arrangement remains with the flying structure. Weight issues may be mitigated by relieving the flying structure from the weight of a handle while relieving the user from managing the rotational arrangement.

In this document, the terms "a" or "an" are used, as is common in patent documents, to include one or more than one. In this document, the term "or" is used to refer to a nonexclusive or, such that "A or B" includes "A but not B," "B but not A," and "A and B," unless otherwise indicated. Furthermore, all publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

The above description is intended to be illustrative, and not restrictive. For example, the above-described embodiments (or one or more aspects thereof) may be used in combination with each other. Other embodiments will be apparent to those of skill in the art upon reviewing the above description. The scope of the claims should, therefore, be determined with reference to the appended claims, along with the full scope of equivalents to which such claims are entitled. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The Abstract is provided to comply with 37 C.F.R. §1.72 (b), which requires that it allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment.

What is claimed is:

1. An apparatus comprising:

a flying structure configured to be controlled;

a control surface on the flying structure; and a rotational arrangement comprising a tether coupled to a handle and to the flying structure, the tether being retractable into the body of the flying structure, the rotational arrangement being configured to allow a user to impart rotational movement to the flying structure, the rotational arrangement being further configured to allow an automatic variation of the length of the tether deployed between the handle and the flying structure.

2. The apparatus of claim 1, wherein the tether being arranged to receive one or more adjustments, the one or more adjustments being based on a centripetal force and a position of the tether such that the tether is extended between the user and the flying structure.

3. The apparatus of claim 2, wherein the tether includes at least one pliable material arranged to sustain a tensional force, the tensional force being applied automatically such that the at least one pliable material is extended between the user and the flying structure.

4. The apparatus of claim 3, wherein the rotational arrangement includes a pulley system configured to permit the at least one pliable material to be positioned.

5. The apparatus of claim 2, wherein the tether is arranged to sustain a resistive force that affects one or more rates at which the tether is positioned, wherein a magnitude of the resistive force is based at least in part on a mass of the flying structure.

6. The apparatus of claim 5, wherein the resistive force is configured to absorb at least part of an end-of-travel force associated with the tether being positioned.

7. The apparatus of claim 5, wherein a magnitude of the resistive force is further based on a tangential velocity of the flying structure.

8. The apparatus of claim 5, wherein the resistive force is user-adjustable.

9. The apparatus of claim 2, wherein the rotational arrangement includes a spooling mechanism configured to unwind the tether, the spooling mechanism being further configured to apply a resistive force to the tether.

10. The apparatus of claim 2, wherein the tether includes one or more pliable materials that possess elastic properties, wherein a resistive force is generated by the one or more pliable materials.

11. The apparatus of claim 2, wherein the rotational arrangement includes one or more frictional components configured to make contact with the tether, wherein a resistive force is based on the contact.

12. The apparatus of claim 11, wherein a frictional force produced by the one or more frictional components is based on an angle at which the tether is positioned.

13. The apparatus of claim 2, wherein the rotational arrangement is configured to allow the one or more automatic adjustments to return the tether from being positioned, based on the flying structure being released from rotation.

14. The apparatus of claim 2, wherein the rotational arrangement includes a spooling mechanism configured to wind up the positioned tether.

15. The apparatus of claim 14, wherein the spooling mechanism is configured to control one or more rates at which the tether is wound up.

16. The apparatus of claim 2, wherein the rotational arrangement includes a pulley system to return the tether from being positioned.

17. The apparatus of claim 2, wherein the rotational arrangement is configured to recycle energy associated with positioning the tether.

18. The apparatus of claim 17, wherein the recycled energy is used to return the tether from being positioned.

19. The apparatus of claim 17, wherein the recycled energy is used to power electronics associated with at least one of the rotational arrangement and the flying structure.

20. The apparatus of claim 1, wherein the rotational arrangement is configured to allow release of the flying structure from rotation.

21. The apparatus of claim 1, wherein the rotational arrangement is configured to allow the user to release the rotational arrangement to allow release of the flying structure from rotation.

22. The apparatus of claim 21, wherein the rotational arrangement is configured to allow disconnection from the flying structure following being released by the user.

23. The apparatus of claim 1, wherein the rotational arrangement is configured to be fixedly coupled to the flying structure such that at least part of the rotational assembly remains with the flying structure following a release of the flying structure from rotation.

24. The apparatus of claim 1, wherein the flying structure and the rotational arrangement are configured to incorporate the rotational arrangement within the flying structure.

25. The apparatus of claim 1, wherein the rotational arrangement includes a grippable handle coupled to an tether, the tether being stored within the flying structure, wherein the grippable handle is configured to facilitate user-extension of the tether from the flying structure, during rotation.

26. The apparatus of claim 25, wherein the handle includes at least one of a quick release and a snap shackle arranged to disconnect the user from the rotational arrangement.

27. The apparatus of claim 25, wherein the handle includes a transmitter to wirelessly transmit a release command to trigger disconnection of the rotational assembly from the user.

28. The apparatus of claim 25, wherein the handle includes a transmitter to wirelessly transmit a movement command to trigger movement of a control surface associated with the flying structure so as to change a direction of the flying structure.

29. The apparatus of claim 25, wherein the handle includes a release mechanism configured to automatically disconnect the rotational arrangement from the user, based on exceeding a predetermined tensional force exerted by one or more portions of the rotational arrangement.

30. The apparatus of claim 25, wherein the handle includes a release mechanism configured to automatically disconnect the rotational arrangement from the user, based on a position of one or more portions of the rotational arrangement.

31. The apparatus of claim 1, wherein the rotational arrangement includes a user employable trigger, wherein the automatic variation of the radius of rotation is responsive to the trigger.

32. The apparatus of claim 1, wherein the automatic variation of the radius of rotation includes at least one of automatically increasing the radius of rotation and automatically decreasing the radius of rotation.

* * * * *